US011029627B2

(12) United States Patent
Kataoka et al.

(10) Patent No.: US 11,029,627 B2
(45) Date of Patent: Jun. 8, 2021

(54) IMAGE HEATING APPARATUS AND IMAGE FORMING APPARATUS

(71) Applicant: CANON KABUSHIKI KAISHA, Tokyo (JP)

(72) Inventors: Hiroshi Kataoka, Suntou-gun (JP); Atsushi Iwasaki, Susono (JP); Hirokazu Okugawa, Mishima (JP); Munehito Kurata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/779,991

(22) Filed: Feb. 3, 2020

(65) Prior Publication Data

US 2020/0174409 A1 Jun. 4, 2020

Related U.S. Application Data

(63) Continuation of application No. PCT/JP2018/029100, filed on Aug. 2, 2018.

(30) Foreign Application Priority Data

Aug. 4, 2017 (JP) ..... JP2017-151516
Jul. 27, 2018 (JP) ..... JP2018-141516

(51) Int. Cl.
*G03G 15/20* (2006.01)

(52) U.S. Cl.
CPC ..... *G03G 15/2039* (2013.01); *G03G 15/2042* (2013.01); *G03G 15/2053* (2013.01)

(58) Field of Classification Search
CPC ..... G03G 15/2039; G03G 15/2042; G03G 15/2053
See application file for complete search history.

(56) References Cited

U.S. PATENT DOCUMENTS 9,075,357 B2 7/2015 Kishi et al.
10,054,882 B2 8/2018 Nomura et al.
10,197,959 B2 2/2019 Takagi
(Continued)

FOREIGN PATENT DOCUMENTS

JP 06095540 A 4/1994
JP 2014178344 A 9/2014
(Continued)

OTHER PUBLICATIONS

Copending, Unpublished U.S. Appl. No. 16/715,340, to Shinji Hashiguchi, filed Dec. 16, 2019.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

In a fixing apparatus 200 having a heater 300 capable of selectively causing a plurality of heat generating blocks divided in a longitudinal direction of a substrate 305 to generate heat, an energization control portion 400 acquires, when performing a fixing operation, a cumulative amount of heat generation in each of a plurality of heating areas, a cumulative rotation time of a pressure roller 208, and information on a recording material that passes through a fixing nip portion, and controls energization of heat generating elements 302*a* and 302*b* on the basis of the acquired information.

20 Claims, 19 Drawing Sheets

(56) References Cited

U.S. PATENT DOCUMENTS

| | | | | |
|---|---|---|---|---|
| 10,545,435 | B2 | 1/2020 | Uchiyama et al. | |
| 2011/0091251 | A1 | 4/2011 | Kim | |
| 2014/0227001 | A1* | 8/2014 | Kishi | G03G 15/2042 399/69 |
| 2015/0037052 | A1* | 2/2015 | Muramatsu | G03G 15/2042 399/45 |
| 2015/0253704 | A1* | 9/2015 | Hirose | G03G 15/2039 399/33 |
| 2015/0323892 | A1* | 11/2015 | Sakamaki | G03G 15/2053 399/327 |
| 2018/0210380 | A1* | 7/2018 | Uchiyama | H04N 1/00891 |
| 2019/0324389 | A1 | 10/2019 | Jota et al. | |
| 2020/0125014 | A1 | 4/2020 | Uchiyama et al. | |

FOREIGN PATENT DOCUMENTS

| | | | |
|---|---|---|---|
| JP | 2014178668 | A | 9/2014 |
| JP | 2014228677 | A | 12/2014 |
| JP | 2015045672 | A | 3/2015 |
| JP | 2015176010 | A | 10/2015 |
| JP | 2016065914 | A | 4/2016 |

OTHER PUBLICATIONS

International Search Report issued in corresponding international parent application No. PCT/JP2018/029100 dated Sep. 18, 2018.
International Preliminary Report on Patentability, dated Feb. 4, 2020, in corresponding PCT Application No. PCT/JP2018/029100.

* cited by examiner

| | $A_1$ | $A_2$ | $A_3$ | $A_4$ | $A_5$ | $A_6$ | $A_7$ |
|---|---|---|---|---|---|---|---|
| $T_1$ | AN | AI | AI | AI | AP | AP | AN |
| $T_2$ | AN | AP | AP | AI | AI | AP | AN |
| $T_3$ | AN | AP | AP | AI | AI | AP | AN |
| $T_4$ | AN | AP | AP | AI | AI | AP | AN |
| $T_5$ | AN | AP | AP | AP | AP | AP | AN |

IMAGE HEATING APPARATUS AND IMAGE FORMING APPARATUS

CROSS-REFERENCE TO RELATED APPLICATIONS

This application is a Continuation of International Patent Application No. PCT/JP2018/029100, filed Aug. 2, 2018, which claims the benefit of Japanese Patent Applications No. 2017-151516, filed Aug. 4, 2017 and No. 2018-141516, filed Jul. 27, 2018, both of which are hereby incorporated by reference herein in their entirety.

BACKGROUND OF THE INVENTION

Field of the Invention

The present invention relates to an image heating apparatus such as a fixing unit mounted to an image forming apparatus such as copier or a printer using an electrophotographic system or an electrostatic recording system, a gloss imparting apparatus which reheats a toner image fixed to a recording material in order to improve a gloss value of the toner image, or the like. The present invention also relates to an image forming apparatus equipped with the image heating apparatus.

Background Art

There is an image heating apparatus which includes an endless belt (also referred to as an endless fixing film), a heater which comes into contact with an inner surface of the endless belt and which generates heat by energization, and a roller that forms a nip portion together with the heater via the endless belt. Due to its small heat capacity, the image heating apparatus has characteristically superior quick-start ability and power saving ability. In recent years, in image heating apparatuses provided in image forming apparatuses such as copiers and laser printers, there are needs for reducing power consumption and reducing wait times. While a start-up time for placing an image heating apparatus in a state where fixing can be executed can be reduced by inputting a large amount of energy, inputting a large amount of energy is not preferable from the perspective of energy saving. In consideration thereof, energy saving as compared to conventional image heating apparatuses is being promoted by making improvements such as reducing a heat capacity of each member that constitutes an image heating apparatus, reducing thickness of members responsible for heat transfer as means for increasing heat conductivity, or using members with higher heat conductance. As further power saving, a configuration (PTL 1) is proposed in which a toner image portion formed on a recording material is selectively heated. The configuration is a divided heater in which a heat generation range of a heater is divided into a plurality of heat generating blocks (heating areas) with respect to a longitudinal direction of the heater (a direction perpendicular to a transport direction of a recording material P). The divided heater selectively controls heat generation of each heat generating block in accordance a presence or an absence of an image on the recording material. In other words, in a portion (a non-image portion) where an image is absent on the recording material, power saving is achieved by stopping energization to a heat generating block. In this manner, attempts are being made to promote energy saving by making improvements and configuration changes from various perspectives such as reducing heat capacity by reducing a size or a thickness of members, increasing thermal conduction or heat insulation of the members, and selectively heating only necessary image portions.

However, in the course of promoting a reduction in the heat capacity of an entire image heating apparatus or an increase in thermal conduction of members thereof, a decline in print quality and durability attributable to a change in the image heating apparatus such as abrasion of a superficial layer of a fixing member or a change in hardness of a pressing member have become a problem.

An object of the present invention is to provide a technique that enables uniform fixing performance and stable recording material transportability to be always obtained throughout a lifespan of an image heating apparatus even when use conditions of a user differ including various images and recording materials.

CITATION LIST

Patent Literature

PTL 1 Japanese Patent Application Laid-open No. H06-95540

SUMMARY OF THE INVENTION

In order to achieve the object described above, an image heating apparatus according to the present invention is an image heating apparatus including:

an image heating portion which has a heater including a substrate and a plurality of heat generating elements provided on the substrate and aligned in a longitudinal direction of the substrate, a cylindrical film that rotates while an inner surface thereof comes into contact with the heater, and a pressing member that comes into contact with an outer surface of the film and rotates, the image heating portion heating an image formed on a recording material using heat of the heater while sandwiching and transporting the recording material at a nip portion between the film and the pressing member; and an energization control portion which selectively controls energization of the plurality of heat generating elements so as to selectively heat a plurality of heating areas in accordance with information of the image, wherein the image heating apparatus includes an acquisition portion which acquires a cumulative amount of heat generation of the heat generating element in each of the plurality of heating areas, a cumulative rotation time of the pressing member, and an information of the recording material that passes through the nip portion, and the energization control portion controls energization of the plurality of heat generating elements on the basis of the information acquired by the acquisition portion.

In order to achieve the object described above, an image forming apparatus according to the present invention is an image forming apparatus including:

an image forming portion which forms an image on a recording material; and a fixing portion which fixes an image formed on the recording material to the recording material, wherein the fixing portion is the image heating apparatus described above.

Further features of the present invention will become apparent from the following description of exemplary embodiments (with reference to the attached drawings).

DESCRIPTION OF THE EMBODIMENTS

A mode for implementing the present invention will now be exemplarily described in detail based on embodiments with reference to the drawings. It is to be understood that dimensions, materials, shapes, relative arrangements, and the like of configurations described in the embodiments are intended to be changed as deemed appropriate in accordance with configurations and various conditions of apparatuses to which the present invention is to be applied. In other words, the scope of the present invention is not intended to be limited to the embodiments described below.

First Embodiment

1. Configuration of Image Forming Apparatus

Figure 1:
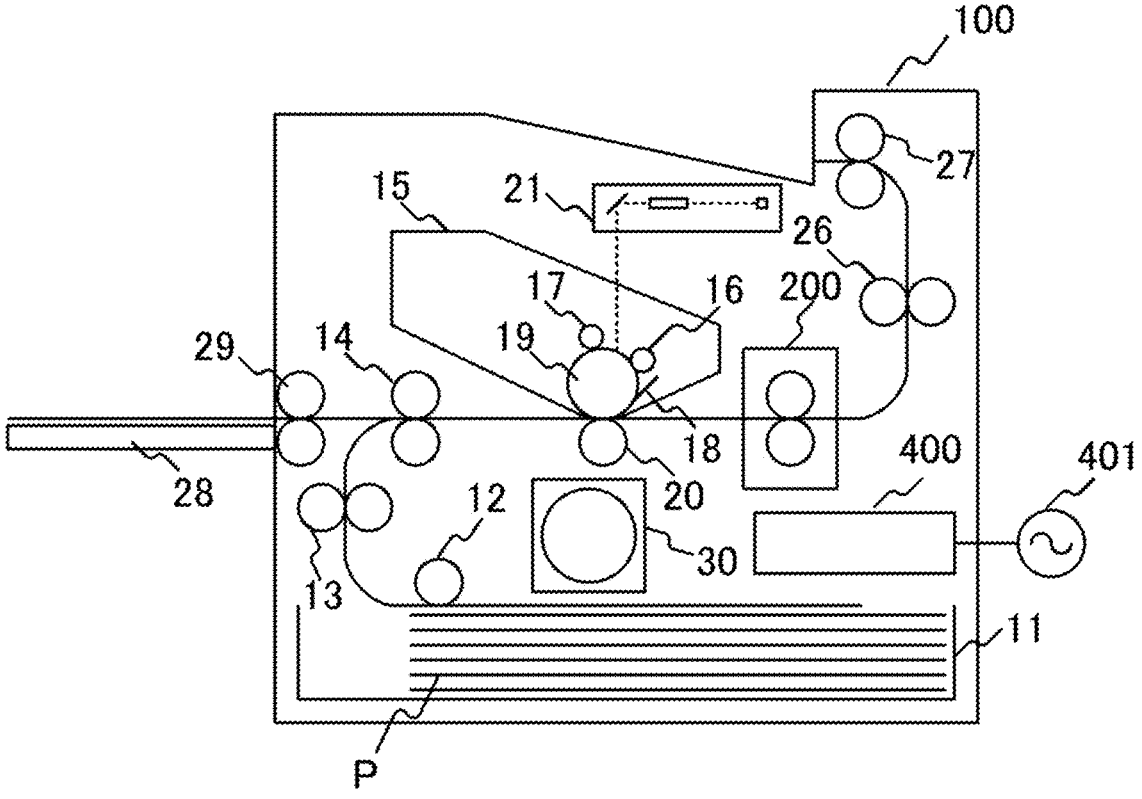
FIG. 1 is a sectional view of an image forming apparatus according to an embodiment of the present invention.

FIG. 1 is a schematic sectional view of an image forming apparatus according to an embodiment of the present invention. An image forming apparatus 100 according to the present embodiment is a laser beam printer which forms an image on a recording material using an electrophotographic system.

When a print signal is generated, a scanner unit 21 emits laser light modulated in accordance with image information to scan a surface of a photosensitive drum (an electrophotographic photosensitive member) 19 charged to a prescribed polarity by a charging roller 16. Accordingly, an electrostatic latent image is formed on the photosensitive drum 19 as an image bearing member. When the electrostatic latent image on the photosensitive drum 19 is supplied with toner from a developing roller 17, the electrostatic latent image on the photosensitive drum 19 is developed as a toner image (a developer image). Meanwhile, a recording material P stacked in a paper feeding cassette 11 is fed one by one by a pickup roller 12, and transported toward a resist roller pair 14 by a transporting roller pair 13. Furthermore, the recording material P is transported in synchronization with the arrival of the toner image on the photosensitive drum 19 at a transfer position formed by the photosensitive drum 19 and a transfer roller 20 from the resist roller pair 14 to the transfer position. The toner image on the photosensitive drum 19 is transferred to the recording material P as the recording material P passes through the transfer position. Subsequently, the recording material P is heated and pressurized by a fixing apparatus (an image heating apparatus) 200 as a fixing portion (an image heating portion) and the toner image is fixed by heat to the recording material P. The recording material P bearing the fixed toner image is discharged to a tray in an upper part of the image forming apparatus 100 by transporting roller pairs 26 and 27.

Residual toner and the like on the surface of the photosensitive drum 19 are removed and cleaned by a cleaner 18. A paper feeding tray (a manual feeding tray) 28 has a pair of recording paper restricting plates of which a width is adjustable in accordance with a size of the recording material P, and the paper feeding tray 28 is provided in order to accommodate recording materials P of sizes other than regular sizes. A pickup roller 29 is a roller for feeding the recording material P from the paper feeding tray 28. A motor 30 drives the fixing apparatus 200 and the like. Power is supplied to the fixing apparatus 200 from a control circuit 400 as an energization control portion and an acquisition portion connected to a commercial AC power supply 401.

The photosensitive drum 19, the charging roller 16, the scanner unit 21, the developing roller 17, and the transfer roller 20 described above constitute an image forming portion which forms an unfixed image on the recording material P. In addition, in the present embodiment, a developing unit including the photosensitive drum 19, the charging roller 16, and the developing roller 17 and a cleaning unit including the drum cleaner 18 are configured as a process cartridge 15 that is attachable to and detachable from an apparatus main body of the image forming apparatus 100.

The image forming apparatus 100 according to the present embodiment has a maximum paper-passing width of 216 mm in a direction that is perpendicular to a transport direction of the recording material P and is capable of printing 41.9 sheets/per minute of A4-size [210 mm×297 mm] ordinary paper at a transport speed of 232.5 mm/sec.

2. Configuration of Image Heating Apparatus

Figure 2:
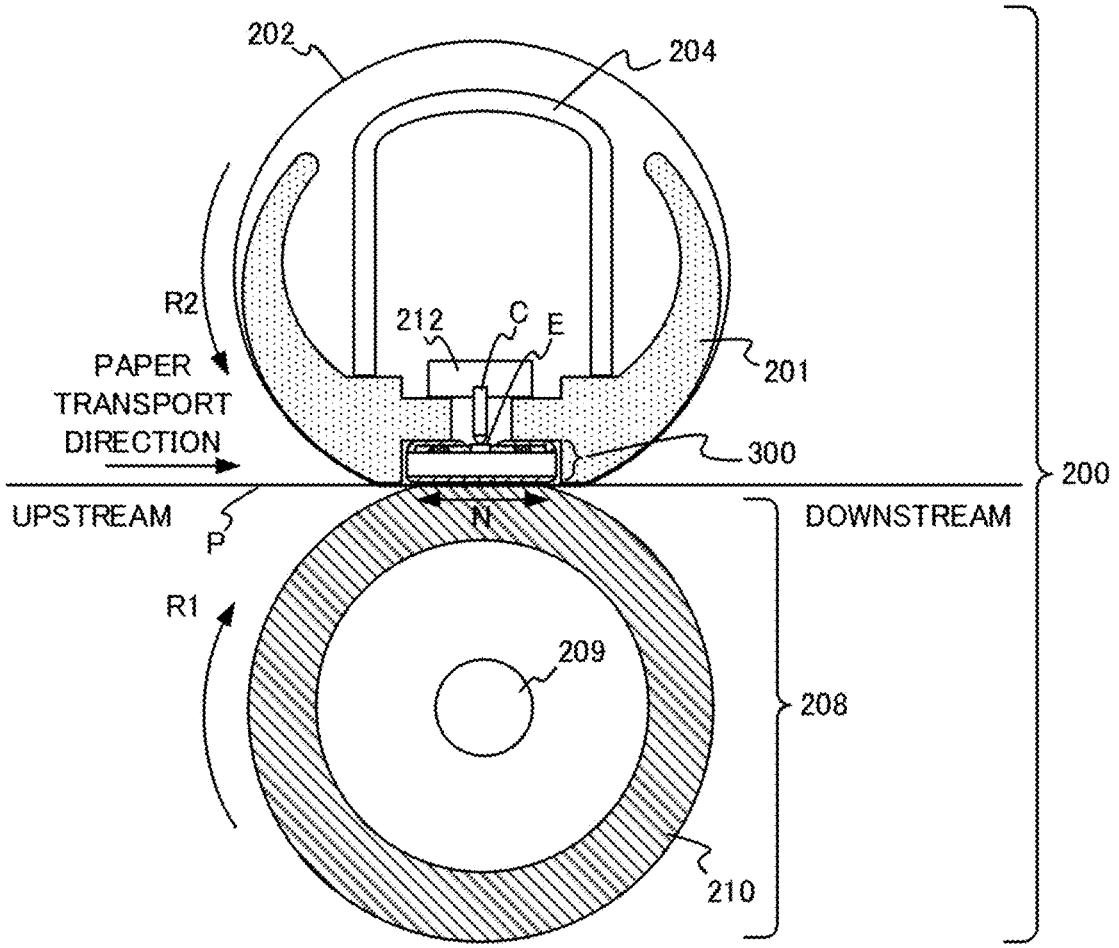
FIG. 2 is a sectional view of an image heating apparatus according to the embodiment of the present invention.

FIG. 2 is a sectional view of the fixing apparatus 200 as an image heating apparatus according to the present embodiment. The fixing apparatus 200 includes a fixing film 202, a heater 300 in contact with an inner surface of the fixing film 202, a pressure roller 208 which forms a fixing nip N together with the heater 300 via the fixing film 202, and a metal stay 204. The fixing film 202 is a highly heat-resistant fixing film with a multilayer configuration and formed in a cylindrical shape which is also referred to as an endless belt or an endless film, and uses a heat-resistant resin such as polyimide or a metal such as stainless steel as a base layer. In addition, a surface of the fixing film 202 is a releasing layer coated with a high-function fluorine resin with superior heat resistance and releasability of PFA and the like for preventing adhesion of toner. Furthermore, particularly in apparatuses which form color images, in order to improve image quality, highly heat-resistant rubber such as silicone rubber may be formed as an elastic layer between the base layer and the releasing layer described above. The pressure roller 208 is configured so as to have a core metal 209 made of a material such as iron or aluminum and an elastic layer 210 made of a highly heat-resistant rubber material such as silicone rubber. A fixing nip N in accordance with the fixing apparatus 200 is obtained by using a pressure roller with appropriate hardness as the pressure roller 208 configured as described above.

The heater 300 is held by a heater holding member 201 made of a heat-resistant resin and heats the fixing film 202 by heating areas $A_1$ to $A_7$ (to be described in detail later) in the fixing nip portion N. The heater holding member 201 also has a guiding function for guiding rotation of the fixing film 202. The heater 300 is provided with an electrode E on an opposite side to the fixing nip N, and power is fed to the electrode E from an electrical contact C. The metal stay 204 receives a pressurizing force (not illustrated) and presses the heater holding member 201 toward the pressure roller 208. In addition, a safety element 212 which is a thermo-switch, a temperature fuse, or the like and which is actuated by abnormal heat generation of the heater 300 to interrupt power supplied to the heater 300 is in direct contact with the heater 300 or in indirect contact with the heater 300 via the heater holding member 201.

The pressure roller 208 rotates in a direction of an arrow R1 due to a rotational driving force received from the motor 30. The rotation of the pressure roller 208 is followed by a rotation in a direction of an arrow R2 of the fixing film 202 of which an outer surface is in contact with the pressure roller 208. An unfixed toner image on the recording material P is subjected to a fixing process by applying heat from a heat generating element arranged on a substrate of the heater 300 via the fixing film 202 while sandwiching and transporting the recording material P at the fixing nip N. In addition, in order to ensure slidability of the fixing film 202 and to create a state of stable driven rotation, a slidable grease (not illustrated) with high heat resistance is interposed between the heater 300 and the fixing film 202.

3. Configuration of Heater 300

Figure 3A:
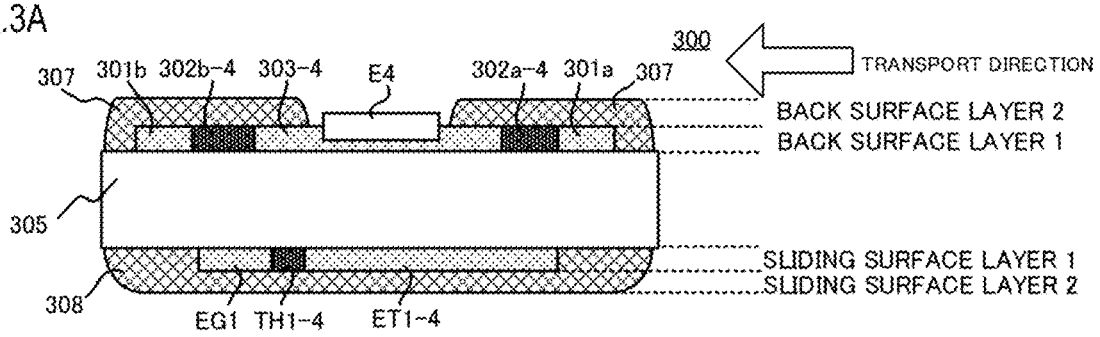
FIGS. 3A to 3C are configuration diagrams of a heater according to the embodiment of the present invention.
Figure 3B:
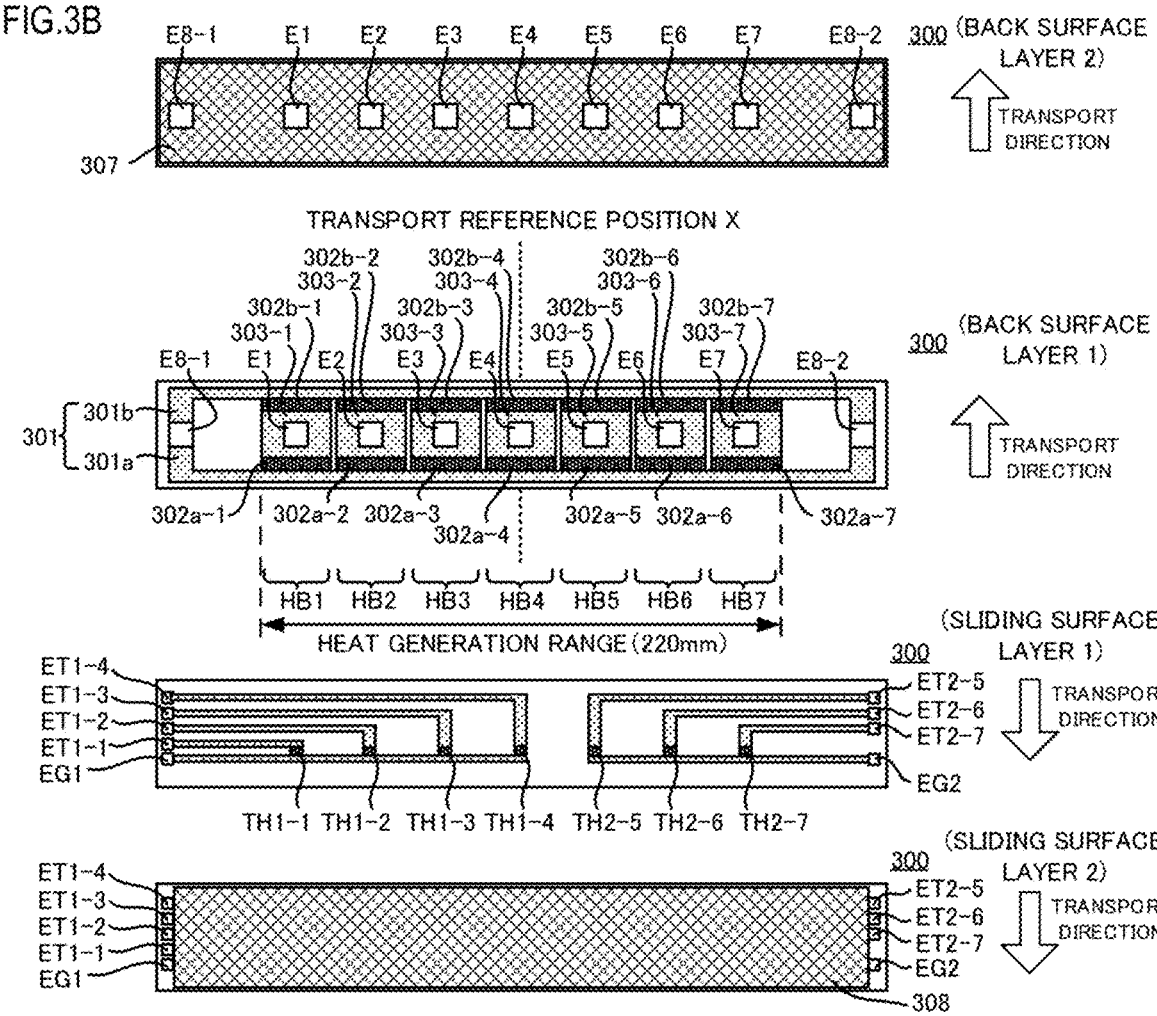
Figure 3C:
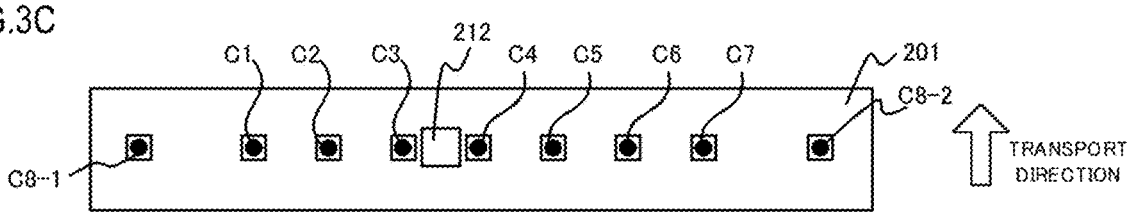

A configuration of the heater 300 according to the present embodiment will be described with reference to FIG. 3. FIG. 3A is a sectional view of the heater 300, FIG. 3B is a plan view of respective layers of the heater 300, and FIG. 3C is a diagram illustrating a connection method of the electrical contact C to the heater 300. FIG. 3B shows a transport reference position X of the recording material P in the image forming apparatus 100 according to the present embodiment. The transport reference in the present embodiment is a center reference, and the recording material P is transported so that a center line in a direction perpendicular to the transport direction of the recording material P follows the transport reference position X. In addition, FIG. 3A represents a sectional view of the heater 300 at the transport reference position X.

The heater 300 is constituted by a substrate 305 made of a ceramic, a rear surface layer 1 provided on the substrate 305, a rear surface layer 2 covering the rear surface layer 1, a sliding surface layer 1 provided on a surface of the substrate 305 on an opposite side to the rear surface layer 1, and a sliding surface layer 2 covering the sliding surface layer 1.

The rear surface layer 1 has conductors 301 (301*a* and 301*b*) provided in the longitudinal direction of the heater 300. The conductors 301 are separated into the conductor 301*a* and the conductor 301*b*, and the conductor 301*b* is provided on a downstream side in the transport direction of the recording material P with respect to the conductor 301*a*. In addition, the rear surface layer 1 has conductors 303 (303-1 to 303-7) provided parallel to the conductors 301*a* and 301*b*. The conductors 303 are provided in the longitudinal direction of the heater 300 between the conductor 301*a* and the conductor 301*b*.

Furthermore, the rear surface layer 1 has heat generating elements (heat generating resistors) 302*a* (302*a*-1 to 302*a*-7) and heat generating elements 302*b* (302*b*-1 to 302*b*-7). The heat generating elements 302*a* are provided between the conductor 301*a* and the conductors 303 and generate heat due to power supplied via the conductor 301*a* and the conductors 303. The heat generating elements 302*b* are provided between the conductor 301*b* and the conductors 303 and generate heat due to power supplied via the conductor 301*b* and the conductors 303.

A heat generating part constituted by the conductors 301, the conductors 303, the heat generating elements 302*a*, and the heat generating elements 302*b* is divided into seven heat generating blocks ($HB_1$ to $HB_7$) with respect to the longitudinal direction of the heater 300. In other words, the heat generating elements 302*a* are divided into seven areas of the heat generating elements 302*a*-1 to 302*a*-7 with respect to the longitudinal direction of the heater 300. In addition, the heat generating elements 302*b* are divided into seven areas of the heat generating elements 302*b*-1 to 302*b*-7 in the longitudinal direction of the heater 300. Furthermore, the conductors 303 are divided into seven areas of the conductors 303-1 to 303-7 in accordance with the dividing positions of the heat generating elements 302*a* and 302*b*. A heat generation range according to the present embodiment is a range from a left end of the heat generating block $HB_1$ in the diagram to a right end of the heat generating block $HB_7$ in the diagram, and a total length of the heat generation range is 220 mm. In addition, while the heat generating blocks respectively have a same length in the longitudinal direction of approximately 31 mm, the heat generating blocks may have different lengths in the longitudinal direction.

The rear surface layer 1 has electrodes E ($E_1$ to $E_7$, $E_{8-1}$, and $E_{8-2}$). The electrodes $E_1$ to $E_7$ are respectively provided in areas of the conductors 303-1 to 303-7 and are electrodes for supplying power to the respective heat generating blocks $HB_1$ to $HB_7$ via the conductors 303-1 to 303-7. The electrodes $E_{8-1}$ and $E_{8-2}$ are provided at ends of the heater 300 in the longitudinal direction so as to be connected to the conductors 301 and are electrodes for supplying power to the heat generating blocks $HB_1$ to $HB_7$ via the conductors 301. While the electrodes $E_{8-1}$ and $E_{8-2}$ are provided at both ends of the heater 300 in the longitudinal direction in the present embodiment, for example, a configuration may be adopted in which only the electrode $E_{8-1}$ is provided on one side. In addition, while power is supplied to the conductors 301*a* and 301*b* by a common electrode, the conductors 301*a* and the conductors 301*b* may be provided with separate electrodes and power supply may be performed separately.

The rear surface layer 2 is constituted by a surface protection layer 307 (in the present embodiment, glass) having an insulating property and covers the conductors 301, the conductors 303, and the heat generating elements 302*a* and 302*b*. In addition, the surface protection layer 307 is formed with the exception of locations of the electrodes E (so that the electrodes E are exposed) and is configured such that the electrical contact C can be connected to the electrodes E from a side of the rear surface layer 2 of the heater 300.

The sliding surface layer 1 has thermistors TH (TH1-1 to TH1-4 and TH2-5 to TH2-7) for detecting a temperature of each heat generating block HB1 to HB7. The thermistors TH are made of a material with PTC characteristics or NTC characteristics (in the present embodiment, NTC characteristics), and the thermistors TH are configured so as to be capable of detecting the temperatures of all heat generating blocks by detecting a resistance value thereof.

In addition, in order to electrify the thermistors and detect a resistance value thereof, the sliding surface layer 1 has conductors ET (ET1-1 to ET1-4 and ET2-5 to ET2-7) and conductors EG (EG1 and EG2). The conductors ET1-1 to ET1-4 are respectively connected to the thermistors TH1-1 to TH1-4. The conductors ET2-5 to ET2-7 are respectively connected to the thermistors TH2-5 to TH2-7. The conductor EG1 is connected to the four thermistors TH1-1 to TH1-4 and forms a common conduction path. The conductor EG2 is connected to the three thermistors TH2-5 to TH2-7 and forms a common conduction path. The conductors ET and the conductors EG are respectively formed in the longitudinal direction of the heater 300 up to longitudinal ends thereof and are connected at the longitudinal ends of the heater 300 to the control circuit 400 via an electrical contact (not illustrated).

The sliding surface layer 2 is constituted by a surface protection layer 308 (in the present embodiment, glass) having slidability and an insulating property and covers the thermistors TH, the conductors ET, and the conductors EG while ensuring slidability with the inner surface of the fixing film 202. In addition, the surface protection layer 308 is formed with the exception of both longitudinal ends of the heater 300 in order to provide electrical contacts with respect to the conductors ET and the conductors EG.

A connection method of the electrical contacts C to the respective electrodes E will be described. FIG. 3C is a plan view from the side of the heater holding member 201 showing how each electrical contact C is connected to each electrode E. The heater holding member 201 is provided with through-holes at positions corresponding to the electrodes E ($E_1$ to $E_7$, $E_{8-1}$, and $E_{8-2}$). At each through-hole position, each of the electrical contacts C ($C_1$ to $C_7$, $C_{8-1}$, and $C_{8-2}$) is electrically connected by means such as biasing by a spring or welding to each of the electrodes E ($E_1$ to $E_7$, $E_{8-1}$, and $E_{8-2}$). Each electrical contact C is connected to the control circuit 400 (to be described later) of the heater 300 via a conductive material (not illustrated) provided between the metal stay 204 and the heater holding member 201.

4. Configuration of Heater Control Circuit

Figure 4:
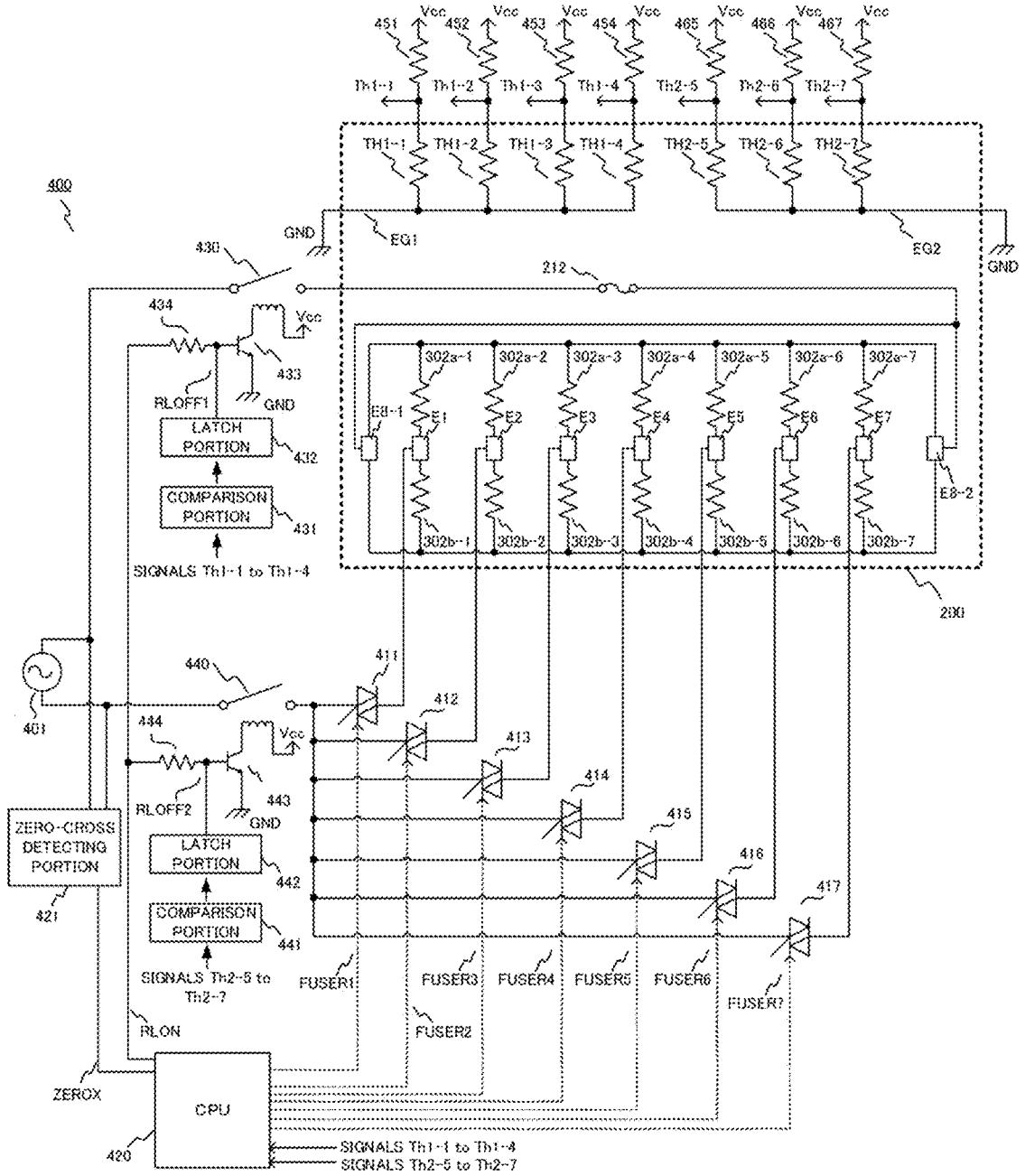
FIG. 4 is a control circuit diagram of the heater according to the embodiment of the present invention.

FIG. 4 shows a circuit diagram of the control circuit 400 of the heater 300 according to the first embodiment. A commercial AC power supply 401 is connected to the image forming apparatus 100. Power control of the heater 300 is performed by electrifying/interrupting energization of triacs 411 to 417. The triacs 411 to 417 respectively operate in accordance with signals FUSER1 to FUSER7 from a CPU 420. Driving circuits of the triacs 411 to 417 are shown in an abbreviated form. The control circuit 400 of the heater 300 has a circuit configuration which enables the seven heat generating blocks $HB_1$ to $HB_7$ being divided in the longitudinal direction to be individually and independently controlled by selectively controlling the seven triacs 411 to 417. A zero-cross detecting portion 421 is a circuit which detects a zero cross of the AC power supply 401 and which outputs a zero cross signal to the CPU 420. The zero cross signal is used for detecting timings of phase control and wave number control of the triacs 411 to 417 and the like.

A method of detecting the temperature of the heater 300 will now be described. Temperature detection of the heater 300 is performed by the thermistors TH (TH1-1 to TH1-4 and TH2-5 to TH2-7) as temperature detecting elements constituting a temperature detecting portion. Divided voltage of the thermistors TH1-1 to TH1-4 and resistors 451 to 454 is detected as signals TH1-1 to TH1-4 by the CPU 420, and the CPU 420 converts the signals TH1-1 to TH1-4 into temperatures. In a similar manner, divided voltage of the thermistors TH2-5 to TH2-7 and resistors 465 to 467 is detected as signals TH2-5 to TH2-7 by the CPU 420, and the CPU 420 converts the signals TH2-5 to TH2-7 into temperatures.

In internal processing by the CPU 420, power to be supplied is calculated by, for example, PI control (proportional-integral control) based on a control temperature (a control target temperature) $TGT_i$ of each heat generating block (to be described later) and a detected temperature of a thermistor. Furthermore, supplied power is converted into a control level of a phase angle (phase control) or a wave number (wave number control) corresponding to the power, and the triacs 411 to 417 are controlled based on control conditions thereof.

Circuit operations of the relay 430 will now be described. When the CPU 420 changes a RLON signal to a High state, a transistor 433 as a drive element is switched to an ON state, a secondary-side coil of the relay 430 is electrified by a power supply voltage Vcc, and a primary-side contact of the relay 430 is switched to an ON state. When the CPU 420 changes the RLON signal to a Low state, the transistor 433 is switched to an OFF state, a current flowing from the power supply voltage Vcc to the secondary-side coil of the relay 430 is interrupted, and the primary-side contact of the relay 430 is switched to an OFF state. The relay 440 performs similar operations. It should be noted that resistors 434 and 444 are resistors that restrict base currents of the transistors 433 and 443.

The relay 430 and the relay 440 ensure safety by being used as means which interrupt power to the heater 300 when the temperature of the heater 300 rises excessively due to a failure or the like. Operations (interrupt operations that interrupt supply of power to the heat generating elements) of a safety circuit (a power interrupting portion) using the relay 430 and the relay 440 will now be described. When any one of the detected temperatures having been detected by the thermistors Th1-1 to TH1-4 exceeds a set prescribed temperature, the relay 430 is placed in a non-conductive state to ensure safety. Specifically, the comparison portion 431 operates a latch portion (a latch circuit) 432 and the latch portion 432 latches a RLOFF1 signal to a Low state. When the RLOFF1 signal assumes a Low state, since the transistor 433 is kept in an OFF state even when the CPU 420 changes the RLON signal to a High state, the relay 430 can be kept in an OFF state (a safe state). In a similar manner, when any one of the detected temperatures having been detected by the thermistors TH2-5 to TH2-7 exceeds a set prescribed temperature, a comparison portion 441 operates a latch portion 442 and the latch portion 442 latches an RLOFF2 signal to a Low state, thereby placing the relay 440 in a non-conductive state to ensure safety.

5. Heating Areas

Figure 5:
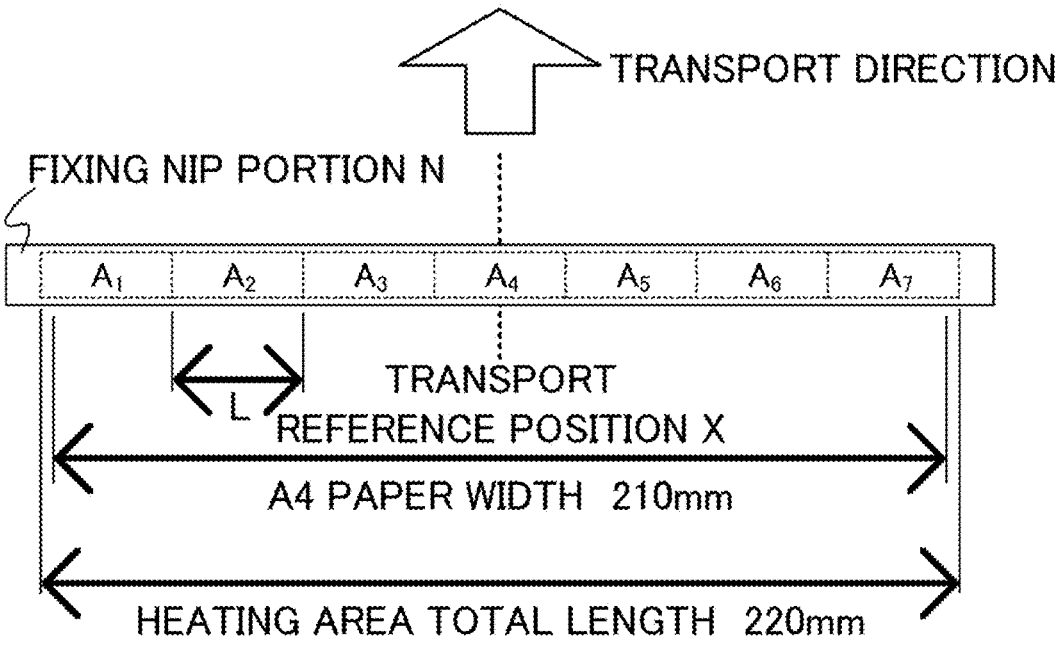
FIG. 5 is a diagram showing heating areas according to the embodiment of the present invention.

FIG. 5 is a diagram displaying the heating areas $A_1$ to $A_7$ according to the present embodiment in comparison with a width of an A4-size recording material. The heating areas $A_1$ to $A_7$ are areas corresponding to the heat generating blocks $HB_1$ to $HB_7$ in the fixing nip N, and each heating area $A_i$ (where i=1 to 7) is heated by heat generation of the heat generating block $HB_i$ (where i=1 to 7). A total length of the heating areas $A_1$ to $A_7$ is 220 mm, and each of the areas is an equal 7-way division thereof (L=31.4 mm).

Figures 6A, 6B:
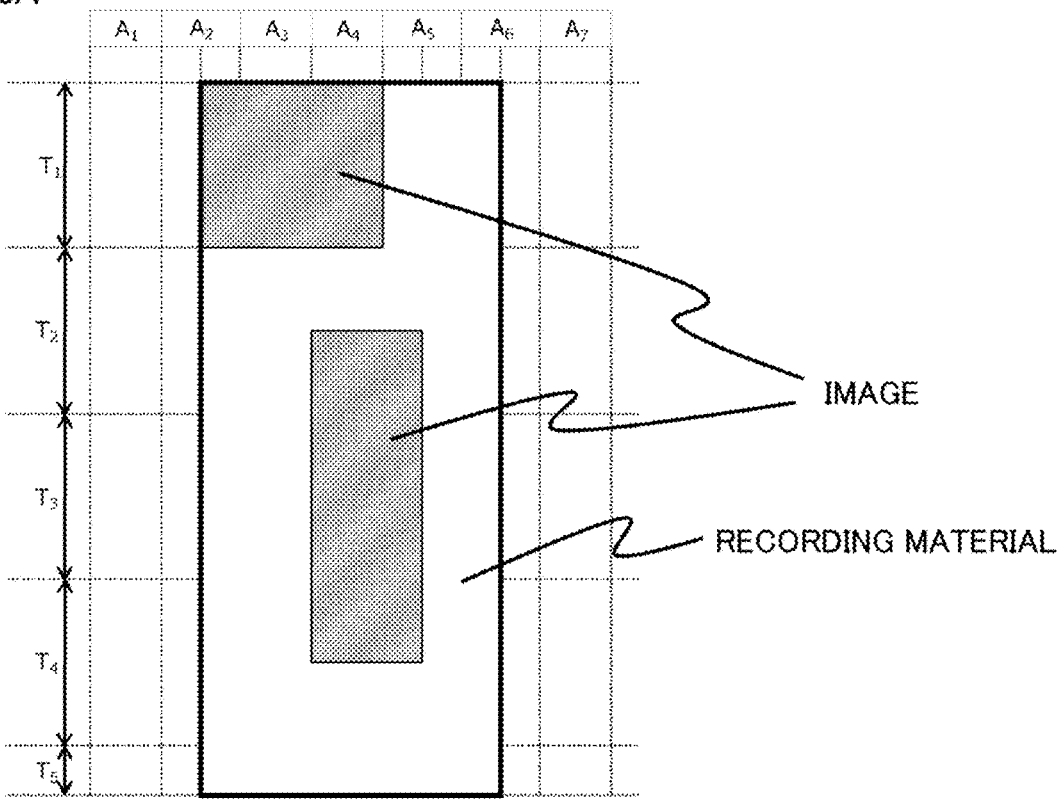
FIGS. 6A and 6B are explanatory diagrams related to classification of heating areas according to the embodiment of the present invention.

A classification of the heating area $A_i$ in consideration of a position of a toner image formed on the recording material P will be described with reference to FIG. 6. In the present embodiment, the recording material P passing through the fixing nip N is divided into sections of a prescribed time, and classification of the heating area $A_i$ is performed for each of the sections. As shown in FIG. 6A, the division into sections according to the present embodiment is provided every 0.3 seconds with a tip of the recording material P as a reference, in which case a first section is referred to as a section $T_1$, a second section is referred to as a section $T_2$, a third section is referred to as a section $T_3$, and so on. When a size of the recording material P is a size such that an end portion thereof passes through the heating area $A_2$ and the heating area $A_6$ and an image is present at a position shown in FIG. 6A, the classification of the heating area $A_i$ is as presented in a table shown in FIG. 6B.

In the section $T_1$, since the recording material P does not pass through the heating areas $A_1$ and $A_7$, the heating areas $A_1$ and $A_7$ are classified as non-paper-passing heating areas AN (Non Paper Areas). On the other hand, since an image range passes through the heating areas $A_2$, $A_3$, and $A_4$, the heating areas $A_2$, $A_3$, and $A_4$ are classified as image heating areas AI (Image Areas), but since the image range does not pass through the heating areas $A_5$ and $A_6$, the heating areas $A_5$ and $A_6$ are classified as non-image heating areas AP (Paper Areas). In a similar manner, in the sections $T_2$ to $T_4$, the heating areas $A_1$ and $A_7$ are classified as non-paper-passing heating areas AN, the heating areas $A_2$, $A_3$, and $A_6$ are classified as non-image heating areas AP, and the heating areas $A_4$ and $A_5$ are classified as image heating areas AI. In addition, in the section $T_5$, the heating areas $A_1$ and $A_7$ are classified as non-paper-passing heating areas AN and the heating areas $A_2$ to $A_6$ are classified as non-image heating areas AP.

6. Problems Caused by Reduced Heat Capacity of Image Heating Apparatus and Increased Thermal Conduction of Members As described above, in the course of promoting a reduction in the heat capacity of an entire image heating apparatus or an increase in thermal conduction of members thereof, declines in print quality and durability attributable to a change in the image heating apparatus such as abrasion of a superficial layer of a fixing member or a change in hardness of a pressing member become a problem. A detailed description will be given below.

First, the fixing member will be described. When the fixing member responsible for heat transfer frictionally slides in a high temperature state, abrasion occurs on a sliding surface and, consequently, thermal conductivity changes depending on a degree of the abrasion. In some cases, the change prevents fixing performance from being stable throughout a lifespan. For example, generally, as a superficial layer of a fixing film that is a fixing member, a superficial layer coated with a fluorine resin is widely used in order to prevent adhesion of toner. Specific examples include fluorine resins such as PFA (tetrafluoroethylene-perfluoro alkyl vinyl ether copolymer) and PTFE (polytetrafluoroethylene) which are highly heat-resistant resins with superior releasability. Since these fluorine resins have low thermal conductivity, a thickness thereof has a large impact on the fixing performance of the image heating apparatus. When the fixing film superficial layer abrades and becomes thinner, heat from the heater as a heating source is readily transferred to toner and the recording material through the fixing film and, in the technical field of electrophotography, problems arise such as an occurrence of a general hot offset and an occurrence of a curl phenomenon in which a discharged recording material curves.

A hot offset is a phenomenon that occurs when toner on the recording material excessively melts due to an excessive amount of supplied heat. Viscosity of excessively melted toner decreases, causing separation (peeling off) to occur inside a toner layer when the recording material separates from the fixing film, and causing the toner to remain on the fixing film. The toner remaining on the fixing film ends up being fixed onto the recording material after one rotation of the fixing film and creates a stain on the recording material. A curl also occurs due to an excessive amount of supplied heat with respect to the recording material at the fixing nip. When the fixing film superficial layer abrades and becomes thinner, an increase in an amount of supplied heat from a side of the fixing film when the recording material passes through the fixing nip disrupts a balance of thermal contraction between front and rear surfaces of the recording material, and stress created by the disruption of balance causes the recording material P to curve and curl.

Next, the pressing member will be described. The pressure roller that is a pressing member repetitively expands when heated and contracts when cooled. In addition, due to stress received by repetitive deformation when passing through the fixing nip, tension of a PFA resin layer that forms a superficial layer of the pressure roller declines. Furthermore, when silicone rubber that forms an elastic layer deteriorates and elasticity thereof declines, hardness of the pressure roller decreases. When the hardness of the pressure roller decreases, a width of the fixing nip that is formed by applying a prescribed pressurizing force between the fixing film and the pressure roller widens, thereby increasing time required by the recording material to pass through the fixing nip and extending heating time of the recording material. As a result, the amount of supplied heat to the recording material and the toner increases and causes problems such as a hot offset and a curl to occur.

As a response to the problem of destabilization of the fixing performance due to a cumulative amount of use of the fixing film or the pressure roller, a conventionally-conceived coping technique involves changing conditions under which fixing is executed in accordance with a use status of the image heating apparatus. For example, a condition such as a fixing control temperature is changed every number of prints set in advance. However, in an image heating apparatus using a divided heater having a plurality of heat generating blocks, since various pieces of image information are to be accommodated, an amount of heat generation differs from one heat generating block to the next. Therefore, the abrasion of the superficial layer of the fixing film described above also differs from one heat generating block to the next. As a result, uniformity of fixing performance (fixability or a gloss value) is diminished and transportability of the recording material becomes unstable in the longitudinal direction that is orthogonal to the transport direction of the recording material 7. Overview of Control Method of Heater 300

A control method of the heater 300 or, in other words, a heat generation amount control method of each heat generating block $HB_i$ (where i=1 to 7) according to the present embodiment and based on the classification of the heating area $A_i$ will now be described. The amount of heat generation of the heat generating block $HB_i$ is determined by supplied power to the heat generating block $HB_i$. By increasing the supplied power to the heat generating block $HB_i$, the amount of heat generation of the heat generating block $HB_i$ increases, and by reducing the supplied power to the heat generating block $HB_i$, the amount of heat generation of the heat generating block $HB_i$ decreases. The supplied power to the heat generating block $HB_i$ is calculated on the basis of a fixing control temperature $TGT_i$ (where i=1 to 7) set for each heat generating block and a detected temperature of the thermistors TH1-1 to TH1-4 and TH2-5 to TH2-7. In the present embodiment, supplied power is calculated by PI control (proportional-integral control) so that the detected temperature of each of the thermistors TH1-1 to TH1-4 and TH2-5 to TH2-7 equals the control temperature $TGT_i$ of each heat generating block $HB_i$.

Figure 7:
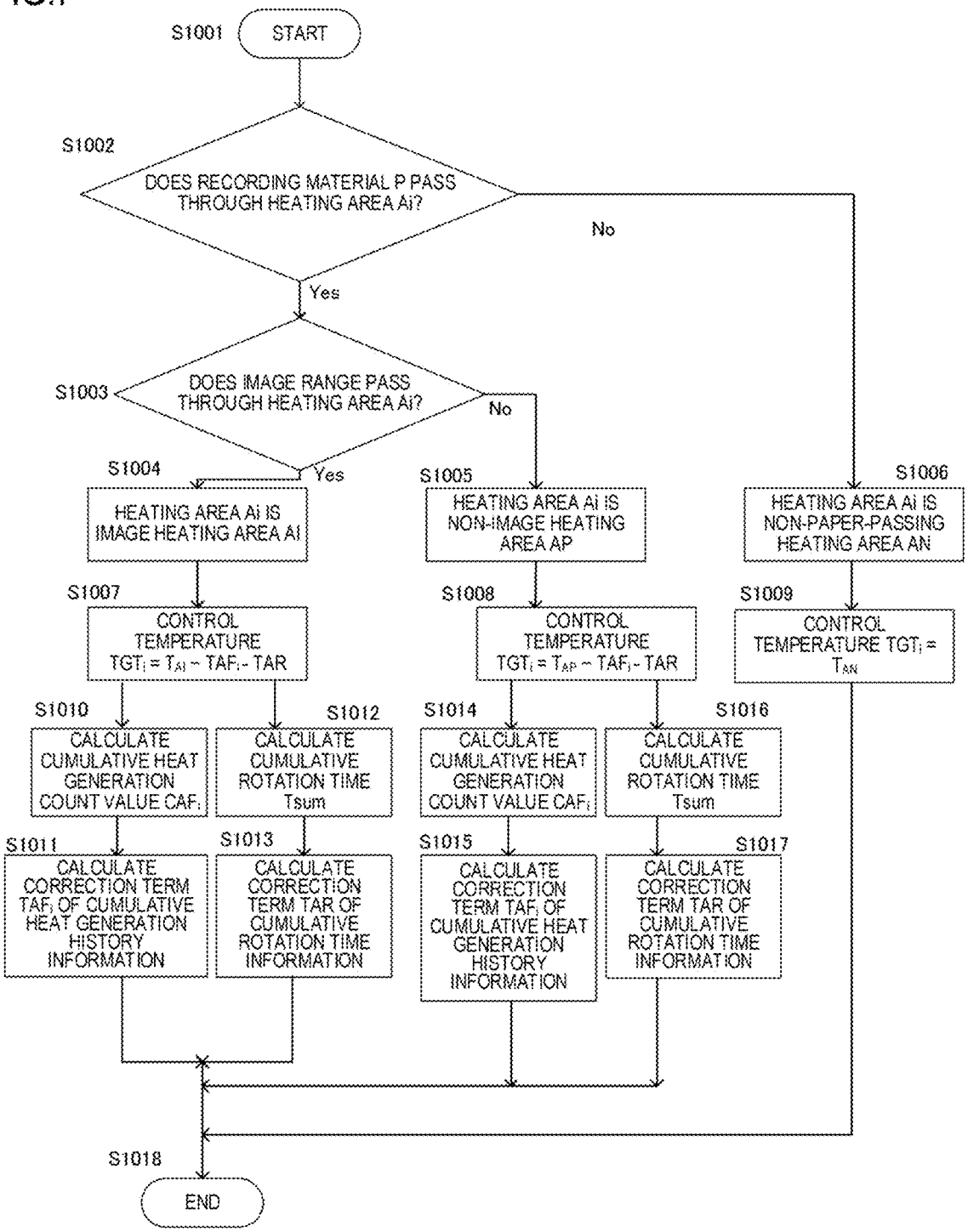
FIG. 7 is a flow chart according to the embodiment of the present invention.

The control temperature $TGT_i$ of each heat generating block is set in accordance with the classification of the heating area $A_i$ determined by a flow chart shown in FIG. 7. The classification of the heating area $A_i$ is performed on the basis of image data (image information) sent from an external apparatus (not illustrated) such as a host computer and size information of the recording material P. In other words, whether or not the recording material P passes through the heating area $A_i$ is determined (S1002), and when the recording material P does not pass through the heating area $A_i$, the heating area $A_i$ is classified as a non-paper-passing heating area AN (S1006). When the recording material P passes through the heating area $A_i$, whether or not an image range passes through the heating area $A_i$ is determined (S1003), and the heating area $A_i$ is classified as an image heating area AI when the image range passes through the heating area $A_i$ (S1004) but the heating area $A_i$ is classified as a non-image heating area AP when the image range does not pass through the heating area $A_i$ (S1005).

First, a case where the heating area $A_i$ is classified as an image heating area AI (S1004) will be described. The fixing control temperature $TGT_i$ when the heating area $A_i$ is classified as an image heating area AI is set such that $TGT_i=T_{AI}-TAF_i-TAR$ (S1007).

In this case, $T_{AI}$ denotes a reference temperature of the image heating area which is set as a suitable temperature for fixing an unfixed toner image to the recording material P. $TAF_i$ (where i=1 to 7) denotes a correction term of cumulative heat generation history information (Accumulation Fever History Information Revision) of each heat generating block $HB_i$. TAR denotes a correction term of cumulative rotation time information (Accumulation Rotation Time Information Revision) of the fixing apparatus 200.

In the fixing apparatus 200 according to the present embodiment, the reference temperature $T_{AI}$ is set to 220° C. when fixing ordinary paper. The reference temperature $T_{AI}$ is desirably suitable for use conditions of the user. The reference temperature $T_{AI}$ is desirably adjusted in accordance with, as use conditions, information related to the recording material P such as a size or a thickness (thick, thin, or the like) as a type or surface properties (smooth, rough, or the like) of the recording material P and information related to a mode of use by the user such as paper-passing mode or environment. The information related to the recording material P may be input by the user to an operating portion (not illustrated) of the image forming apparatus 100 or acquired using a recording material type determining member (not illustrated) provided on a transport path of the recording material P in the image forming apparatus 100. Alternatively, the reference temperature $T_{AI}$ may be adjusted in accordance with information related to an image such as a density of the image, a density of pixels, and an arrangement of the image.

The correction term $TAF_i$ represents a correction value of the fixing control temperature based on a cumulative amount of heat generation of each heat generating block $HB_i$ positioned in each heating area $A_i$, and the correction term $TAF_i$ is adopted in order to correct an amount of abrasion of the superficial layer of the fixing film 202 as temperature. The cumulative amount of heat generation of each heat generating block $HB_i$ is defined as a product of the fixing control temperature and time upon executing fixing, and cumulative amounts of heat generation are added up as a cumulative heat generation count value CAFi (S1010). The correction term $TAF_i$ is calculated based on the count value CAFi (S1011). Details of the calculation of the count value CAFi and the correction term $TAF_i$ will be provided later.

The correction term TAR represents a correction value of the fixing control temperature based on a cumulative rotation time of the fixing apparatus 200 and the correction term TAR is adopted in order to correct a change in hardness of the pressure roller 208. Cumulative rotation times are added up as a cumulative rotation time Tsum (S1012). The correction term TAR is calculated on the basis of the time Tsum (S1013). Details of the calculation of the time Tsum and the correction term TAR will be provided later.

Next, a case where the heating area A, is classified as a non-image heating area AP (S1005) will be described. The fixing control temperature $TGT_i$ when the heating area $A_i$ is classified as a non-image heating area AP is set such that $TGT_i=T_{AP}-TAF_i-TAR$ (S1008).

In this case, $T_{AP}$ denotes a reference temperature of the non-image heating area, and by setting $T_{AP}$ to a lower temperature than the reference temperature $T_{AI}$, the amount of heat generation of the heat generating block $HB_i$ in the non-image heating area AP is reduced as compared to the image heating area AI for the purpose of achieving power saving of the image forming apparatus 100.

However, in some cases, excessively lowering the reference temperature $T_{AP}$ makes it difficult to raise a temperature of an image portion to the control temperature $T_{AP}$ even if maximum power that can be input to the heat generating block $HB_i$ is input when the heating area $A_i$ is switched from a non-image heating area AP to an image heating area AI. In this case, since faulty fixing that is a phenomenon in which a toner image cannot be reliably fixed to the recording material P may possibly occur, the reference temperature $T_{AP}$ must be set to a suitable value. An experiment carried out by the present inventors and the like revealed that, in the fixing apparatus 200 according to the present embodiment, faulty fixing does not occur as long as the reference temperature $T_{AP}$ is set to 162° C. or higher. From the perspective of power saving, since it is desirable to set the control temperature $TGT_i$ as low as possible and reduce the amount of heat generation of the heat generating block $HB_i$, $T_{AP}$ is set to 162° C. in the present embodiment.

Calculation of the count value CAFi and the time Tsum and calculation of the correction term $TAF_i$ and the correction term TAR involve steps (S1014 to S1017) similar to those in the earlier case (S1004) where the heating area A is an image heating area AI.

Next, a case where the heating area $A_i$ is classified as a non-paper-passing heating area AN (S1006) will be described. When the heating area $A_i$ is classified as a non-paper-passing heating area AN, the control temperature $TGT_i$ is set such that $TGT_i=T_{AN}$ (S1009). $T_{AN}$ denotes a reference temperature of the non-paper-passing heating area, and by setting $T_{AN}$ to a lower temperature than the reference temperature $T_{AP}$, the amount of heat generation of the heat generating block $HB_i$ in the non-paper-passing heating area AN is reduced as compared to the non-image heating area AP for the purpose of achieving power saving of the fixing apparatus 200.

However, excessively lowering the reference temperature $T_{AN}$ causes a failure in which slidability between an inner surface of the fixing film 202 and the heater 300 deteriorates and transport of the recording material P becomes unstable. This is attributable to viscosity characteristics of a slidable grease interposed between the fixing film 202 and the heater 300 in which the lower the temperature, the higher the viscosity of the slidable grease, thereby inhibiting rotation of the fixing film 202. An experiment carried out by the present inventors and the like revealed that, in the fixing apparatus 200 according to the present embodiment, transport of the recording material P can be stabilized by setting the reference temperature $T_{AN}$ to 128° C. or higher. From the perspective of power saving, since it is desirable to set the control temperature $TGT_i$ as low as possible and reduce the amount of heat generation of the heat generating block $HB_i$, $T_{AP}$ is set to 128° C. in the present embodiment. It should be noted that the reference temperature $T_{AN}$ is preferably determined in consideration of the configuration of the fixing apparatus 200 including viscosity characteristics of the grease and is not limited to 128° C.

8. Correction Term $TAF_i$ of Cumulative Heat Generation History Information

The fixing film 202 which is used as a basis of calculation of the correction term $TAF_i$ will be described. The superficial layer of the fixing film 202 abrades due to passage of the recording material P. This is because a difference in speeds, albeit extremely minute, is created between the recording material P and the fixing film 202. The fixing apparatus 200 adopting a fixing film system is configured such that, due to rotational drive of the pressure roller 208, the pressure roller 208 transports the recording material P, whereby a friction force between the recording material P and the fixing film 202 causes the fixing film 202 to be driven to rotate. Since the surface of the fixing film 202 is formed by a fluorine resin such as PFA or PTFE in order to obtain releasability, a friction coefficient of the surface of the fixing film 202 is low. In addition, since an inner surface of the fixing film 202 is driven to rotate while rubbing against the heater 300 and the heater holding member 201, a peripheral speed of the fixing film 202 is lower, albeit by an extremely small margin, than a transport speed of the recording material P. The recording material P contains an inorganic substance such as calcium carbonate or kaolin as a loading material for making the recording material P itself white and opaque. The loading material inadvertently acts as an abrasive with respect to the superficial layer of the fixing film 202 and ends up scraping the superficial layer of the fixing film 202.

A rate at which the superficial layer of the fixing film 202 abrades is related to a surface temperature of the fixing film 202 and a time during which the temperature is applied. Fluorine resins such as PFA and PTFE elastically deform due to external stress and soften and deform when heated in a similar manner to general resins. When the temperature of the fixing film 202 rises and the fluorine resin softens, the loading material of the recording material P conceivably digs deeper into the fixing film 202 as the recording material P is pressurized by the fixing nip N. Conceivably, abrasion occurs as an extremely minute difference in speeds is created between the fixing film 202 and the recording material P in this state.

Figure 8:
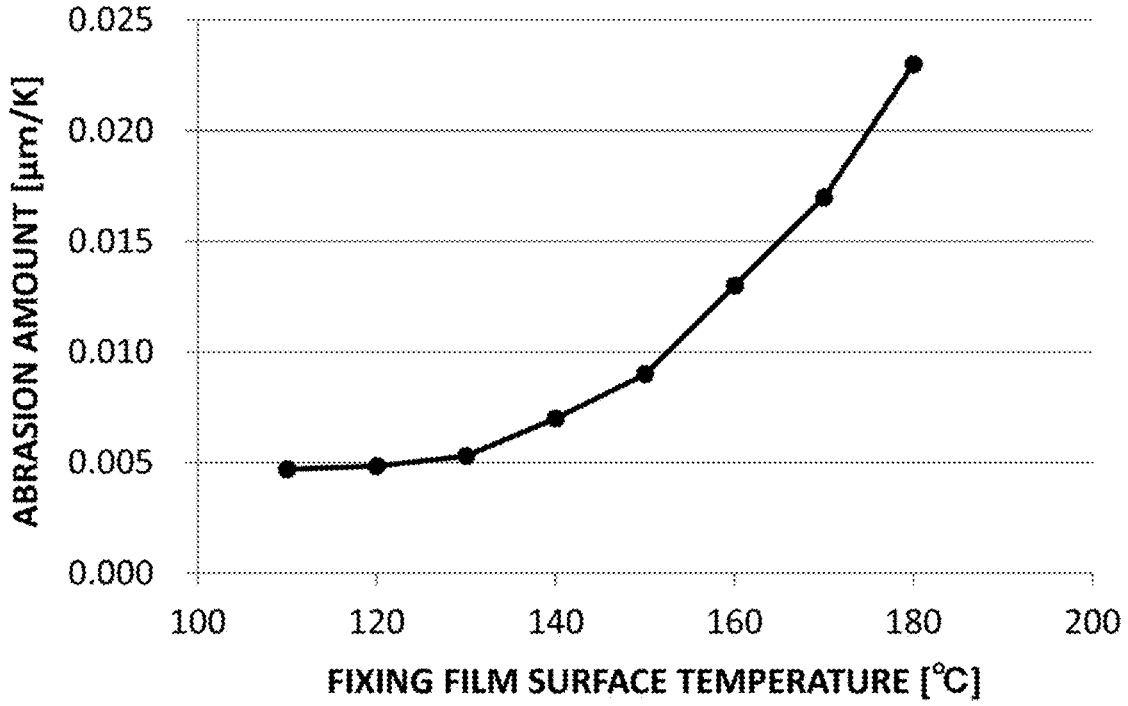
FIG. 8 is a measurement diagram of an abrasion amount of a superficial layer of a fixing film according to the embodiment of the present invention.

FIG. 8 shows a result of verifying abrasion by, in order to assess an effect of temperature on abrasion of a fluorine resin, changing a fixing control temperature of the fixing apparatus 200 to change a temperature of a fluorine resin layer that constitutes the superficial layer of the fixing film 202. In the graph, an abscissa indicates a surface temperature [° C.] of the fixing film 202 and an ordinate indicates an abrasion amount [μm] when passing 1000 [sheets] (1K [sheets]) of an A4-size recording material P with a basis weight of 80 [g/m$^2$]. The graph shows that the higher the surface temperature of the fixing film 202, the larger the abrasion amount. As shown, a superficial layer abrasion of the fixing film 202 is significantly impacted by the surface temperature of the fixing film and a timing at which the fixing film 202 rubs against the recording material P or, in other words, a time at which recording material P passes through the fixing nip N. In consideration thereof, in the present embodiment, a product of a fixing control temperature and a passage time which determine the surface temperature of the fixing film 202 is defined as a parameter for estimating the superficial layer abrasion of the fixing film 202.

In the case of the fixing apparatus 200 verified in the present embodiment, it is shown that optimal fixing performance is obtained by maintaining the surface temperature of the fixing film 202 at approximately 180[° C.]. A superficial layer film thickness of the fixing film 202 in an unused state according to the present embodiment is set to 25 [μm], and it is empirically known that a fixing control temperature for producing a surface temperature of 180[° C.] is 220[° C.]. For this reason, the reference temperature $T_{AI}$ is set to 220[° C.] as described earlier. It should be noted that the fixing control temperature is set so that reliable fixing performance is obtained even in cases where fixability is diminished due to variations in parts that occur when producing the fixing apparatus 200, use conditions of the fixing apparatus 200, and the like. In other words, the reference temperature $T_{AI}$ 220[° C.] is determined by also taking conditions under which fixability is diminished into consideration.

When the superficial layer of the fixing film 202 abrades and becomes thin, controlling the heater 300 that is a heating source to a same temperature (a same amount of heat generation) results in increasing the surface temperature of the fixing film 202 and causing a hot offset or a curl to occur. In order to obtain optimal fixing performance in accordance with the state of the fixing apparatus 200 regardless of use conditions of the user, the superficial layer temperature of the fixing film 202 must be maintained at 180[° C.] even when the superficial layer of the fixing film 202 abrades and becomes thin. In consideration thereof, in the first embodiment of the present invention, the fixing control temperature of each heat generating block $HB_i$ is set to a temperature in accordance with a superficial layer film thickness of the fixing film 202 which opposes the heat generating block $HB_i$. Accordingly, an object of the present invention is to always obtain optimal fixing performance.

In the first embodiment, by storing and sequentially calculating and updating the fixing control temperature $TGT_i$ and a passage time of the recording material P when executing fixing in the nonvolatile memory 410 (refer to FIG. 1), a film thickness of the fixing film 202 is estimated by calculation. The nonvolatile memory 410 may be provided in at least any of the image forming apparatus 100 and the fixing apparatus 200.

The fixing control temperature $TGT_i$ is corrected by reflecting, as the cumulative heat generation count value CAFi, a value calculated as a total value of a product of the fixing control temperature $TGT_i$ and a passage time of the recording material P on the correction term $TAF_i$ described earlier. A relationship between the count value CAFi and the correction term $TAF_i$ will be described later. The fixing apparatus 200 according to the present embodiment uses the heater 300 having heat generating elements divided in plurality in a longitudinal direction of the heater. Therefore, the count value CAFi is obtained for each heat generating block $HB_i$ in order to independently control the count value CAFi as the fixing control temperature $TGT_i$ of each heat generating block $HB_i$.

Calculation of the count value CAFi will be described. As an example, the count value CAFi is calculated when a pattern with an image covering an entire surface thereof is formed on an A4-size recording material P. Since the heating area $A_i$ has an image on an entire surface thereof, the heating area $A_i$ is an image heating area AI and a reference temperature thereof is the reference temperature $T_{AI}$. Division of sections is performed from a passage time 297/232.5 (transport speed)=1.28 [seconds] of the A4-size recording material length 297 [mm] so that passage times $t_1$ to $t_4$ of sections $T_1$ to $T_4$ is 0.3 [seconds] and a remaining time 0.08 [seconds] is a passage time $t_5$ of a section $T_5$. Since an image is present in all of these sections, the count value CAFi will be, on the basis of the expression, reference temperature $T_{AI}*t_1$+reference temperature $T_{AI}*t_2$+reference temperature $T_{AI}*t_3$+reference temperature $T_{AI}*t_4$+reference temperature $T_{AI}*t_5$, 220[° C.]*0.3 [seconds]+220[° C.]*0.3 [seconds]+220[° C.]*0.3 [seconds]+220 [° C.]*0.3 [seconds]+220[° C.]*0.08 [seconds]=281.6.

Since a control portion (not illustrated) of the image forming apparatus 100 is controlled by 16 bits, in order to fit the count value CAFi into 16 bits, a value obtained by the calculation described above is divided by 1000 and rounded up to be adopted as the count value CAFi. Therefore, 0.2816 obtained by dividing 281.6 by 1000 is rounded up and calculated as 1.

When three sheets of the same image pattern are successively passed,

CAFi=(220[° C.]*0.3 [seconds]*4+0.08 [seconds]*1)*3 [sheets]=844.8 is divided by 1000 to obtain 0.8448, which is then rounded up to calculate 1.

Such a calculation of the cumulative heat generation count value CAFi is performed and updated for each execution of fixing through the use of the fixing apparatus 200. By correcting the fixing control temperature $TGT_i$ for each heat generating block $HB_i$ using the count value CAFi obtained from such a calculation as the correction term $TAF_i$ shown in Table 1, the fixing control temperature $TGT_i$ is adjusted to a temperature in accordance with the superficial layer film thickness of the fixing film 202.

TABLE 1

| Count value CAFi | Correction term $TAF_i$ |
|---|---|
| $C_{AFi} < 8{,}500$ | 0 |
| $8{,}500 \le C_{AFi} < 16{,}750$ | −2 |
| $16{,}750 \le C_{AFi} < 24{,}750$ | −4 |
| $24{,}750 \le C_{AFi} < 32{,}600$ | −6 |
| $32{,}600 \le C_{AFi} < 40{,}300$ | −8 |
| $40{,}300 \le C_{AFi} < 47{,}800$ | −10 |
| $47{,}800 \le C_{AFi}$ | −12 |

9. Correction Term TAR of Cumulative Rotation Time Information

The pressure roller 208 which is used as a basis of calculation of the correction term TAR will be described. Since the pressure roller 208 is pressed against the heater 300 via the fixing film 202 under constant pressure, a width of the fixing nip N increases when hardness of the pressure roller 208 is lower (when the pressure roller 208 is softer). When the width of the fixing nip N increases, the time required by the recording material P to pass through the fixing nip N lengthens, an amount of heat transferred from the fixing film 202 to the recording material P and toner increases, and a larger amount of the toner can be melted. On the other hand, when the hardness of the pressure roller 208 is higher (when the pressure roller 208 is harder), the width of the fixing nip N decreases. When the width of the fixing nip N decreases, the time required by the recording material P to pass through the fixing nip N shortens, an amount of heat transferred from the fixing film 202 to the recording material P and toner decreases, and melting of the toner becomes insufficient. The hardness of the pressure roller 208 also decreases (softens) due to a variation (tolerance) in hardness that occurs when producing the pressure roller 208 and by repetitively executing fixing. In consideration of such a variation width of hardness, the hardness of the pressure roller 208 must be set so that reliable fixing performance is obtained at standard upper and lower limits of tolerance of hardness.

A change in hardness of the pressure roller 208 will be described. The hardness of the pressure roller 208 is obtained due to elasticity of a silicone rubber that forms the elastic layer 210 and tension (resilience) of a fluorine resin layer that forms the superficial layer. A change in hardness occurs when the pressure roller 208 of which the temperature has been raised in order to execute fixing becomes subject to a load for transporting the recording material P while repetitively forming the fixing nip N.

Figure 9:
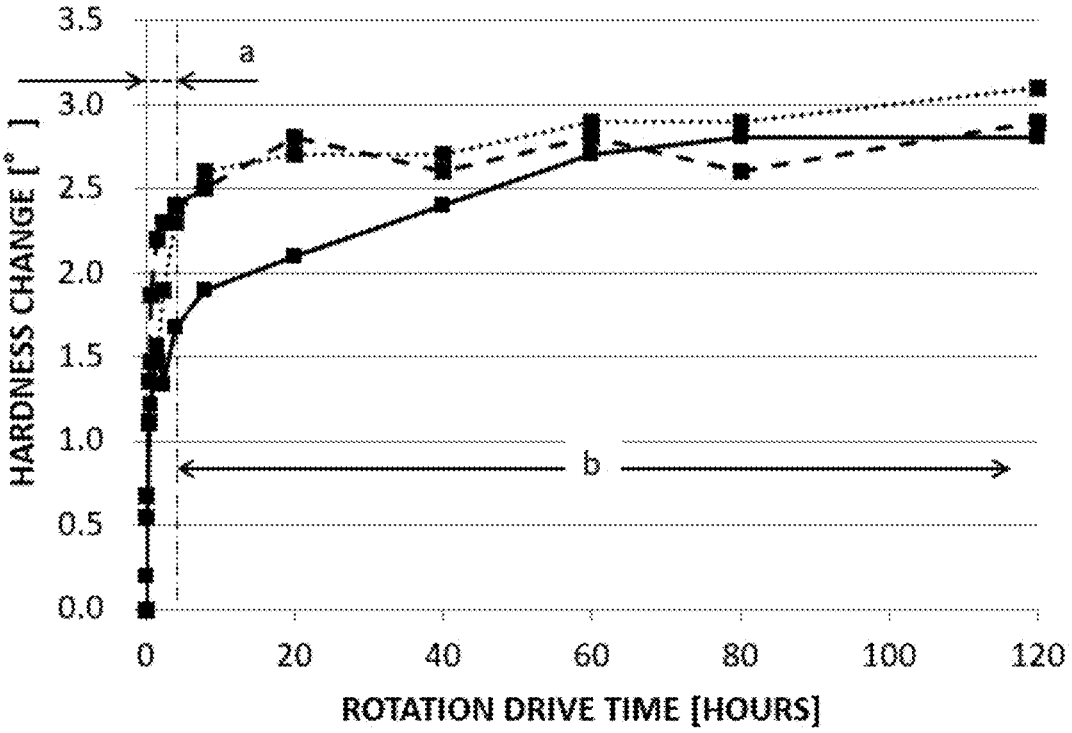
FIG. 9 is a measurement diagram of a change in hardness of a pressure roller according to the embodiment of the present invention.

FIG. 9 shows a change in hardness of the pressure roller 208 which accompanies the passage of paper. An abscissa of the graph represents a rotational drive time of the pressure roller 208 due to the passage of paper and shows that it takes approximately 40 [hours] to pass approximately 50,000 [sheets]. An ordinate represents a change in hardness [°]. As shown in FIG. 9, while the change in hardness of the pressure roller 208 is large immediately after the start of use from a brand-new state (section a), the change in hardness decreases when subsequently passing paper (section b). This trend is due to the following factors.

Since the fixing apparatus 200 according to the present invention is configured such that the pressure roller 208 is responsible for transporting the recording material P, an outer diameter of the pressure roller 208 affects a transport speed of the recording material P. When the outer diameter of the pressure roller 208 increases at an upper limit of outer diameter tolerance, the transport speed of the recording material P increases, but when the outer diameter of the pressure roller 208 decreases at a lower limit of outer diameter tolerance, the transport speed of the recording material P decreases. In the image forming apparatus 100 according to the present invention, the recording material P present at the fixing nip N is also sandwiched and transported by a transfer nip formed by the photosensitive drum 19 and the transfer roller 20 as a roller pair on an upstream side of the fixing nip N and the discharge roller pair 26 which is a roller pair on a downstream side of the fixing nip N. Among these roller pairs, the roller pair having a significant effect on the transport of the recording material P is the fixing nip N which exercises the largest pressurizing force. Therefore, a smaller variation (swing) of the transport speed at the fixing nip N is desirable, and the outer diameter tolerance of the pressure roller 208 is required to be small within a range in which mass production can be performed. In consideration thereof, in order to stabilize the outer diameter tolerance at a small value, a configuration is adopted in which, in a manufacturing stage of the pressure roller 208, the elastic layer 210 is coated with a PFA tube of which an inner diameter is smaller than the outer diameter of the elastic layer 210 to constrict the elastic layer 210 with the PFA tube.

Since the elastic layer 210 is a layer of silicone rubber with a coefficient of linear expansion of 250 to 450 [$10^{-6}$/K] and a thickness of 2.5 [mm], the elastic layer 210 expands as the temperature thereof rises. On the other hand, the PFA resin layer that is a fluorine resin layer as a releasing layer has a smaller coefficient of linear expansion than silicone of 100 to 120 [$10^{-6}$/K] and a thinner film thickness of 50 [μm]. Therefore, when the silicone rubber elastic layer 210 expands, the PFA resin layer is stretched. After execution of fixing, when the fixing apparatus 200 cools down, the silicone rubber elastic layer 210 having been expanded due to the temperature rise contracts due to compression set that is a characteristic of rubber. On the other hand, a contraction variation of the stretched PFA resin layer decreases due to retention of plastic deformation that is a characteristic of resin and remains in a stretched state. When the PFA resin layer remains stretched in such a cycle, tension of the PFA resin layer decreases. Therefore, pressure roller hardness that had been obtained due to tension of the PFA resin layer when the pressure roller was brand-new decreases. The decrease in hardness is large in an initial state as depicted by the section a in FIG. 9.

A subsequent change in hardness is caused by thermal stress due to the temperature rise of the pressure roller 208 and deterioration of silicone rubber due to deformation and loads when repetitively forming the fixing nip N and transporting the recording material P. In comparison to the decline in hardness due to reduced tension in the initial stage, the change in hardness is small and gradual as depicted by the section b.

Figure 10:
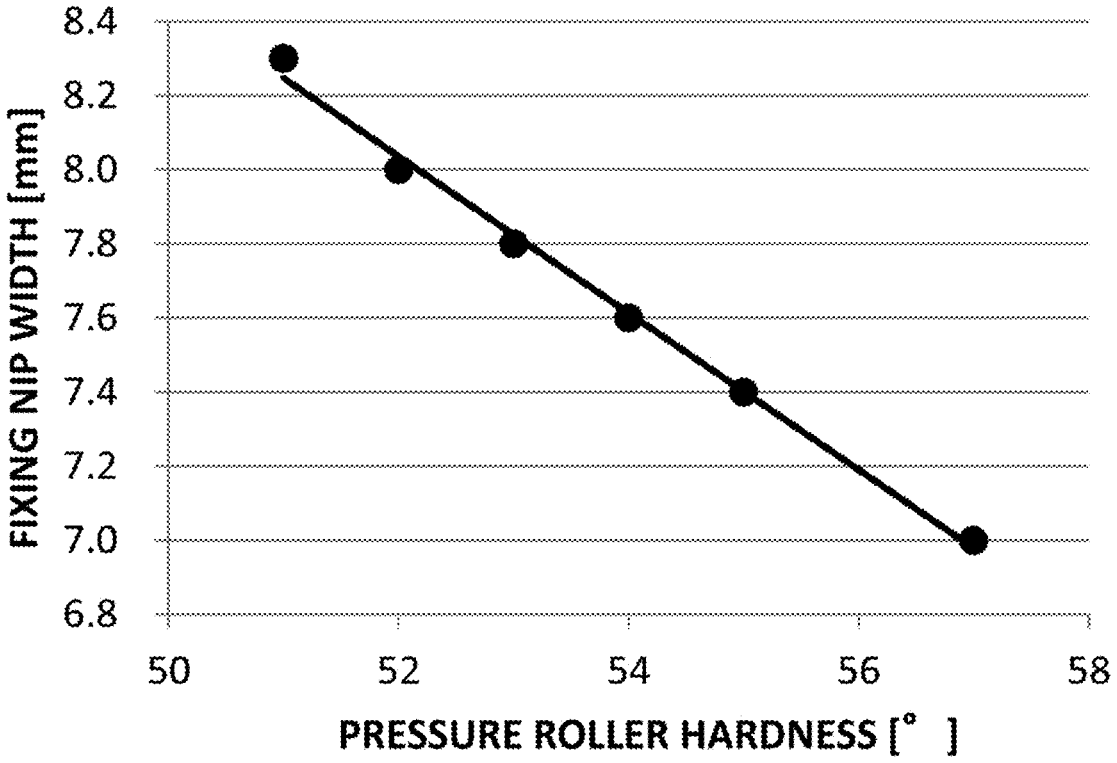
FIG. 10 is a measurement diagram of the hardness of the pressure roller and a width of a fixing nip according to the embodiment of the present invention.

FIG. 10 shows a result of confirmation of a relationship between the hardness of the pressure roller 208 and the width of the fixing nip N according to the present embodiment. In the graph, an abscissa represents pressure roller hardness [°] and an ordinate represents the width [mm] of the fixing nip N. It is shown that the width of the fixing nip N increases by 0.4 [mm] when the pressure roller hardness decreases by 2 [°].

Figure 11:
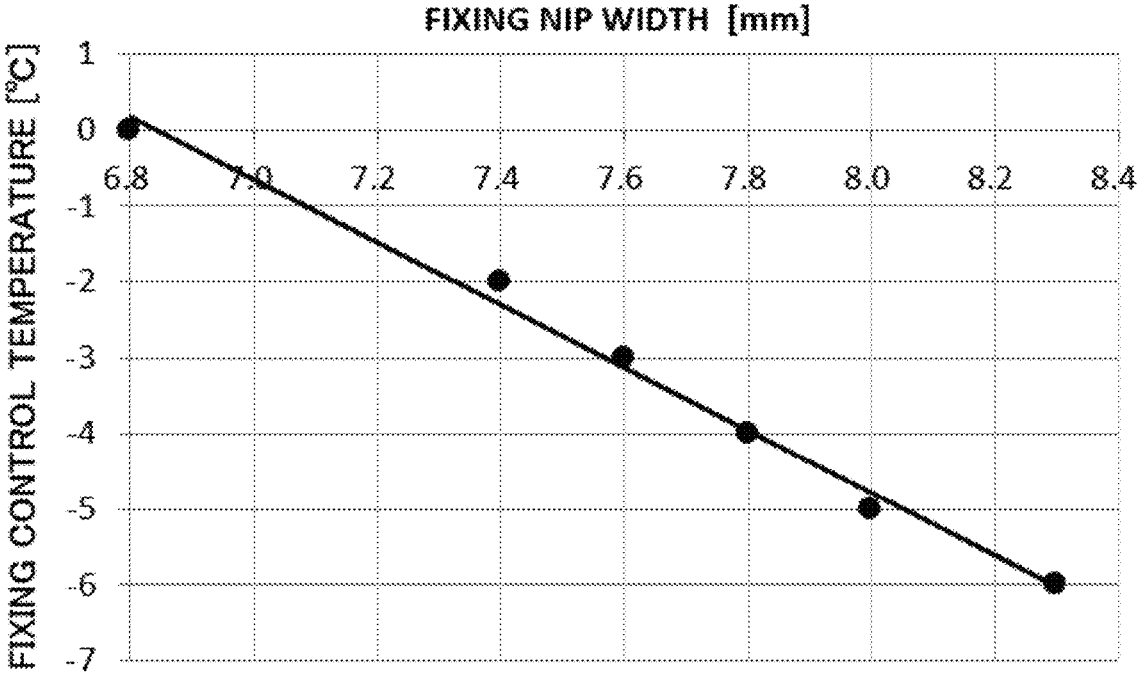
FIG. 11 is a measurement diagram of the width of the fixing nip and a fixing control temperature according to the embodiment of the present invention.

FIG. 11 shows a result of confirmation of the width of the fixing nip N and the fixing control temperature. In the graph, an abscissa represents the width [mm] of the fixing nip N and an ordinate represents a fixing control temperature [° C.] at which optimal fixing performance is obtained. It was found that, when the width of the fixing nip N increases by 0.2 [mm], optimal fixing performance is obtained by lowering the fixing control temperature by approximately 1[° C.].

In the present invention, from the results described above, a cumulation of rotation times of the pressure roller 208 which accompanies execution of fixing is calculated as the time Tsum to be stored in the nonvolatile memory 410 and sequentially calculated and updated. Accordingly, the change in hardness of the pressure roller 208 is estimated and used as the correction term TAR for correcting the fixing control temperature $TGT_i$ in accordance with a change in the width of the fixing nip N.

Since the time Tsum is the same in the longitudinal direction of the pressure roller 208, in the present embodiment, the correction term TAR is not divided for each heat generating block $HB_i$. However, a correction term $TAR_i$ may be calculated for each heat generating block $HB_i$.

The time Tsum is defined as a time during which the pressure roller 208 is rotationally driven.

The image forming apparatus 100 and the fixing apparatus 200 used in the present embodiment have the following steps.

Pre-rotation: This step includes a preparation step of an image-forming step involving stabilizing a potential of the photosensitive drum 19 and stabilizing a rotation of the laser scanner 21 and a step of forming an image on the photosensitive drum 19 and transporting, to the image heating apparatus 100, the recording material P onto which the image on the photosensitive drum 19 has been transferred. This step also includes a step of raising temperatures of the fixing film 202 and the pressure roller 208.

Paper passing: This is a step of passing the recording material P bearing unfixed toner through the fixing nip N to perform fixing.

Inter-sheet: This is a step between transport of the recording material P and transport of a next recording material P when performing continuous paper passing.

Post-rotation: This is a step of discharging the recording material P to the outside of the apparatus and causing the image forming apparatus 100 to make a transition to a standby state.

Time required by each step is as follows:

Pre-rotation: 4.3 [seconds]

Paper passing: 1.28 [seconds] (A4 size: 297 [mm])

Inter-sheet: 0.145 [seconds]

Post-rotation: 0.97 [seconds]

The time Tsum calculated as a time of rotational drive of the fixing apparatus 200 including the respective steps described above is used as the correction term TAR of cumulative rotation time information shown in Table 2. Since a decline in hardness of the pressure roller 208 is significant during an initial period when the pressure roller 208 is brand new, correction of the fixing control temperature $TGT_i$ by the correction term TAR based on the time Tsum is made larger in an initial period after the start of use of the fixing apparatus 200.

TABLE 2

| Time $T_{sum}$ [hours] | Correction term TAR |
|---|---|
| $T \leq 0.5$ | 0 |
| $0.5 < T \leq 1.0$ | −1 |
| $1.0 < T \leq 8$ | −2 |
| $8 < T \leq 40$ | −3 |
| $40 < T$ | −4 |

By combining the correction term TAR of cumulative rotation time information described above and the correction term $TAF_i$ of cumulative heat generation history information described earlier, each heat generating block $HB_i$ is controlled to the fixing control temperature $TGT_i$ that is optimal for a state of the fixing apparatus 200 in accordance with use conditions of the user.

10. Correction of Fixing Control Temperature

Next, correction of the fixing control temperature $TGT_i$ will be described. When an image is present in each heat generating block $HB_i$, control is performed with $TGT_i=T_{AI}-TAF_i-TAR$ (S1007), but when an image is not present in each heat generating block $HB_i$, control is performed with $TGT_i=T_{AP}-TAF_i-TAR$ (S1008). On the other hand, when the recording material P is not present in each heat generating block $HB_i$, correcting the fixing control temperature $TGT_i$ with the correction term $TAF_i$ and the correction term TAR excessively lowers the fixing control temperature $TGT_i$. As a result, as described earlier, since slidability between the inner surface of the fixing film 202 and the heater 300 declines and transport of the recording material P becomes unstable, control is performed with $TGT_i=T_{AN}$ (S1009).

As an example, the correction of the fixing control temperature $TGT_i$ when the fixing apparatus 200 is used, the cumulative heat generation count value CAFi reaches 22,000, and the cumulative rotation time Tsum reaches 32 hours is as follows. When an image is present in the heat generating block $HB_i$, a reference temperature of the image heating area is corrected and control is performed with $TGT_i$=220[° C.]−4[° C.]−3[° C.]=213[° C.]. When an image is not present in the heat generating block $HB_i$, a reference temperature of the non-image heating area is corrected and control is performed with $TGT_i$=162[° C.]−4[° C.]−3[° C.]=155[° C.]. When the recording material P does not pass through the heat generating block $HB_i$, control is performed with $TGT_i$=128[° C.].

Correction of the fixing control temperature $TGT_i$ when repetitively successively passing three sheets of an image pattern shown in FIG. 12A on an A4-size recording material P and then entering a stand-by state will be described. Sections $T_1$ to $T_3$ in the heating areas $A_2$ to $A_5$ are classified as the image heating areas AI in which a toner image is present and controlled at 220[° C.] as the reference temperature $T_{AI}$. Sections $T_1$ to $T_5$ in the heating areas $A_1$, $A_6$, and $A_7$ and sections $T_4$ and $T_5$ in the heating areas $A_2$ to $A_5$ are classified as the non-image heating areas AP in which a toner image is not present and controlled at 162[° C.] as the reference temperature $T_{AP}$.

The count value CAFi per one sheet of the heating areas $A_2$ to $A_5$ in which the image heating area AI and the non-image heating area AP coexist is calculated by $CAF_i$=reference temperature $T_{AI}$*required time of section $T_i$+reference temperature $T_{AP}$*required time of section $T_i$ as $CAF_i$=((220[° C.]*(passage time of sections $T_1$ to $T_3$))+(162[° C.]*(passage time of sections $T_4$ and $T_5$))=(220[° C.]*0.3*[seconds]*3 [sections]))+(162[° C.]*(0.3 [seconds]+0.08 [seconds])=198+61.56=259.56.

The count value $CAF_i$ when successively passing three sheets of paper is 259.56*3=778.68, which is divided by 1000 for the sake of calculations by the CPU as 778.68/1000=0.77868, which is then rounded up to 1.

The cumulative heat generation count value CAFi of the heating areas $A_2$ to $A_5$ due to repetitive paper passing is, p at 32,743 sheets, $CAF_{i(32743)}$=0.77868*(32743/3)=8498.77 which is rounded up to 8499, at 32,744 sheets, $CAF_{i(32744)}$=0.77868*(32744/3)=8499.033 which is rounded up to 8500, and therefore, at a timing where 32,744 sheets are passed, the count value CAFi is 8500 and the correction term $TAF_i$ is a correction of −2[° C.].

The count value CAFi per one sheet of the heating areas $A_1$, $A_6$, and $A_7$ which are non-image heating areas AP is calculated by $CAF_i$=non-reference temperature $T_{AP}$*required time of section $T_i$ as $CAF_i$=162° C.*(0.3*4+0.08*1)=207.36.

The count value CAFi when successively passing three sheets of paper is 207.36*3=622.08, which is divided by 1000 for the sake of calculations by the CPU as 622.08/1000=0.62208, which is then rounded up to 1. Although there is no difference from the heating areas $A_2$ to $A_5$ described earlier where the image heating area AI is present when one sheet is passed, the count value CAFi of the heating areas $A_1$, $A_6$, and $A_7$ due to repetitive paper passing is, at 40,986 sheets, $CAF_i$(40986)=0.62208*(40986/3)=8498.857 which is rounded up to 8499, at 40,987 sheets, $CAF_i$(40987)=0.62208*(40987/3)=8499.064 which is rounded up to 8500, and therefore, at a timing of 40,987 sheets which represents a delay of 8243 sheets as compared to the image heating area AI, the count value CAFi is 8500 and the correction term $TAF_i$ is a correction of −2[° C.].

As described above, with respect to the image heating area AI where an image is present in the heating area $A_i$ and the fixing control temperature $TGT_i$ rises, correction for lowering the fixing control temperature $TGT_i$ is increased in order to realize an optimal correction in consideration of superficial layer abrasion of the fixing film 202.

In a similar manner, the cumulative rotation time Tsum for determining the correction term TAR will be described. The time Tsum required to pass three sheets of paper is obtained including "pre-rotation: 4.3 seconds", "paper passing: 1.28 seconds (A4 size 297 mm)", "inter-sheet: 0.145 seconds", and "post-rotation: 0.97 seconds" described earlier which accompany paper passing. The time Tsum is calculated by pre-rotation time+paper-passing time of 1st sheet+inter-sheet time+paper-passing time of 2nd sheet+inter-sheet time+paper-passing time of 3rd sheet+post-rotation time. In other words, the time Tsum is 4.3+1.28+0.145+1.28+0.145+1.28+0.97=4.3+1.28*3+0.145*2+0.97=9.4 [seconds].

By repeating this calculation, at 574 sheets, $Tsum_{(564)}$=9.4*[574/3]=1798.53 [seconds]=1798.53/3600 [seconds]=0.49959 [hours], at 575 sheets, $Tsum_{(575)}$=9.4*[575/3]=1801.67 [seconds]=1801.67/3600 [seconds]=0.500463 [hours], and the correction term TAR due to a change in hardness of the pressure roller 208 is a correction of −1[° C.] for the 575th and subsequent sheets.

In a similar manner, at 1148 sheets, $Tsum_{(1148)}$=9.4*[1148/3]=3597.07 [seconds]=3597.07/3600 [seconds]=0.999 [hours], at 1149 sheets, $Tsum_{(1149)}$=9.4*[1149/3]=3600.2 [seconds]=3600.2/3600 [seconds]=1.000056 [hours], and the correction term TAR is a correction of −2[° C.] for the 1149th and subsequent sheets.

At 9191 sheets, $Tsum_{(9191}$=9.4*[9191/3]=28798.47 [seconds]=28798.47/3600 [seconds]=7.9996 [hours], at 9192 sheets, $Tsum_{(9192)}$=9.4*[9192/3]=28801.6 [seconds]=28801.6/3600 [seconds]=8.00044 [hours], and the correction term TAR is a correction of −3[° C.] for the 9192nd and subsequent sheets.

At 45,957 sheets, $Tsum_{(45957)}$=9.4*[45957/3]=143998.6 [seconds]=143998.6/3600 [seconds]=39.9996 [hours], at 45,958 sheets, $Tsum_{(45958)}$=9.4*[45958/3]=144001.73 [seconds]=144001.73/3600 [seconds]=40.00048 [hours], and the correction term TAR is a correction of −4[° C.] for the 45,958th and subsequent sheets.

The above results may be compiled as shown in Table 3.

TABLE 3

| | | Correction term $TAF_i$ Toner image in heating area $A_i$ | | Correction term TAR |
|---|---|---|---|---|
| | | Present | Absent | — |
| Number of passed sheets | 574 or less | 0 | 0 | 0 |
| | 575 ~ 1,148 | 0 | 0 | 1 |
| | 1,149 ~ 9,191 | 0 | 0 | −2 |
| | 9,192 ~ 32,743 | 0 | 0 | −3 |
| | 32,744 ~ 45,957 | −2 | 0 | −3 |
| | 45,958 ~ 50,000 | −2 | 0 | −4 |

Until the 574th sheet of passed paper, corrections of the correction term $TAF_i$ and the correction term TAR are not performed and the fixing control temperature $TGT_i$ is a reference temperature in accordance with a presence or absence of an image in each heat generating block $HB_i$.

From the 575th to the 1148th sheet, the correction term TAR is a correction of −1[° C.] and the fixing control temperature $TGT_i$ is obtained by $TGT_i$=reference temperature −1[° C.].

From the 1149th to the 9191st sheet, the correction term TAR is a correction of −2[° C.] and the fixing control temperature $TGT_i$ is obtained by $TGT_i$=reference temperature −2[° C.].

From the 9192nd to the 32,743rd sheet, the correction term TAR is a correction of −3 [° C.] and the fixing control temperature $TGT_i$ is obtained by $TGT_i$=reference temperature −3 [° C.].

From the 32,744th sheet, when an image is present in the heating area $A_i$, due to the correction term $TAF_i$ being a correction of −2[° C.] and the correction term TAR being a correction of −3[° C.], the fixing control temperature $TGT_i$ is obtained by $TGT_i$=reference temperature −2-3[° C.]=reference temperature −5[° C.]. When an image is not present in the heating area $A_i$, only a correction of the correction term TAR is applied and the fixing control temperature TGTi is obtained by $TGT_i$=reference temperature −3[° C.].

From the 45,958th sheet, since the correction term TAR is a correction of −4[° C.], when an image is present in the heating area $A_i$, due to the correction term $TAF_i$ being −2[° C.], the fixing control temperature $TGT_i$ is obtained by $TGT_i$=reference temperature −2-4[° C.]=−6[° C.]. When an image is not present in the heating area $A_i$, only a correction of the correction term TAR is applied and the fixing control temperature $TGT_i$ is obtained by $TGT_i$=reference temperature −4[° C.].

The correction of the correction term TAR is maximal at this timing, and during subsequent paper-passing, the correction term $TAF_i$ is calculated according to the calculation formula described earlier and the fixing control temperature $TGT_i$ is corrected accordingly.

Figure 12A:
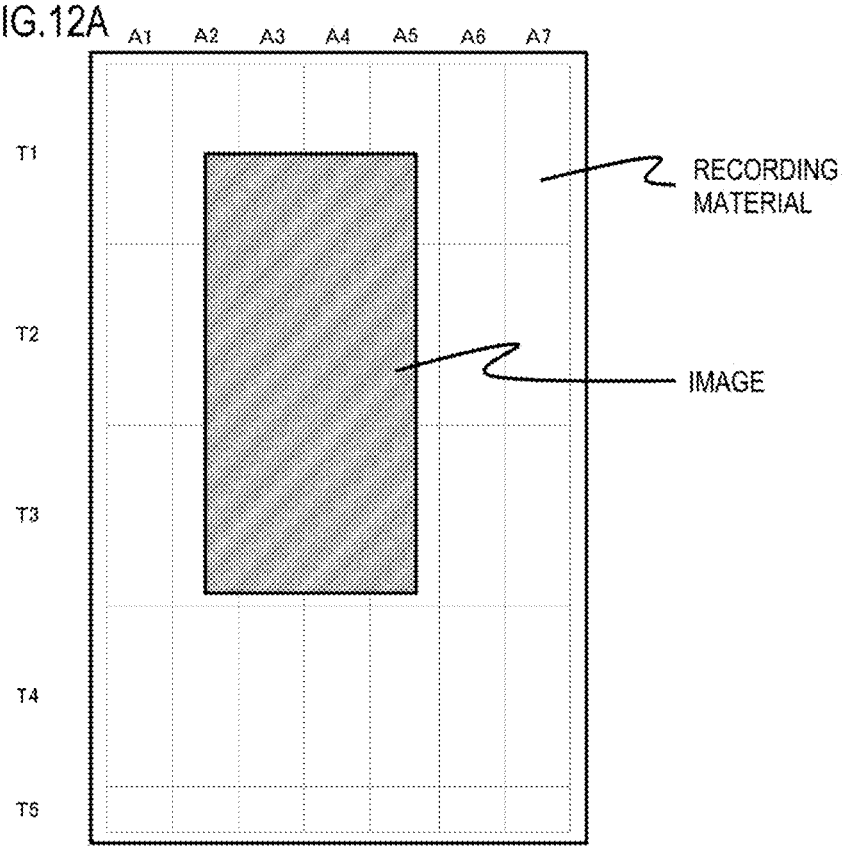
FIGS. 12A and 12B are explanatory diagrams of a verification of effects according to the embodiment of the present invention.

The correction term $TAF_i$ and the correction term TAR described above are the correction terms $TAF_i$ and TAR when repetitively successively passing three sheets of the image pattern shown in FIG. 12A on an A4-size recording material P and then entering a stand-by state. The correction term $TAF_i$ and the correction term TAR change in accordance with an image pattern, a size of the recording material P, paper-passing conditions, and the like.

In the present embodiment, while corrections by the correction term $TAF_i$ and the correction term TAR in accordance with changes in the fixing film 202 and the pressure roller 208 are applied, depending on the fixing apparatus 200, only one of the corrections may be applied. In addition, while corrections by the correction terms $TAF_i$ and TAR are not applied when the recording material P is not present in the heat generating block $HB_i$, depending on the fixing apparatus 200, the corrections may be applied.

11. Effect of Present Embodiment

An effect of the present embodiment will now be described. An object of a comparative example is a fixing apparatus which performs control while setting the fixing control temperature $TGT_i$ of each heat generating block $HB_i$ to a constant value regardless of an amount of use. The effect was verified by repetitively performing a set of successively passing three sheets of the image pattern shown in FIG. 12A on A4-size recording material P and then entering a stand-by state until the number of sheets reached 50,000 sheets. In the image pattern shown in FIG. 12A, control is performed on the premise of the fixing control temperature $TGT_i$ of the heating areas $A_2$, $A_3$, $A_4$, and $A_5$ in which an image is present being high and the fixing control temperature $TGT_i$ of the heating areas $A_1$, $A_6$, and $A_7$ in which an image is not present being low. By continuously passing paper in this state, an amount of superficial layer abrasion of the fixing film 202 corresponding to the heating areas $A_2$, $A_3$, $A_4$, and $A_5$ increases while an amount of superficial layer abrasion corresponding to the heating areas $A_1$, $A_6$, and $A_7$ decreases.

Figure 13:
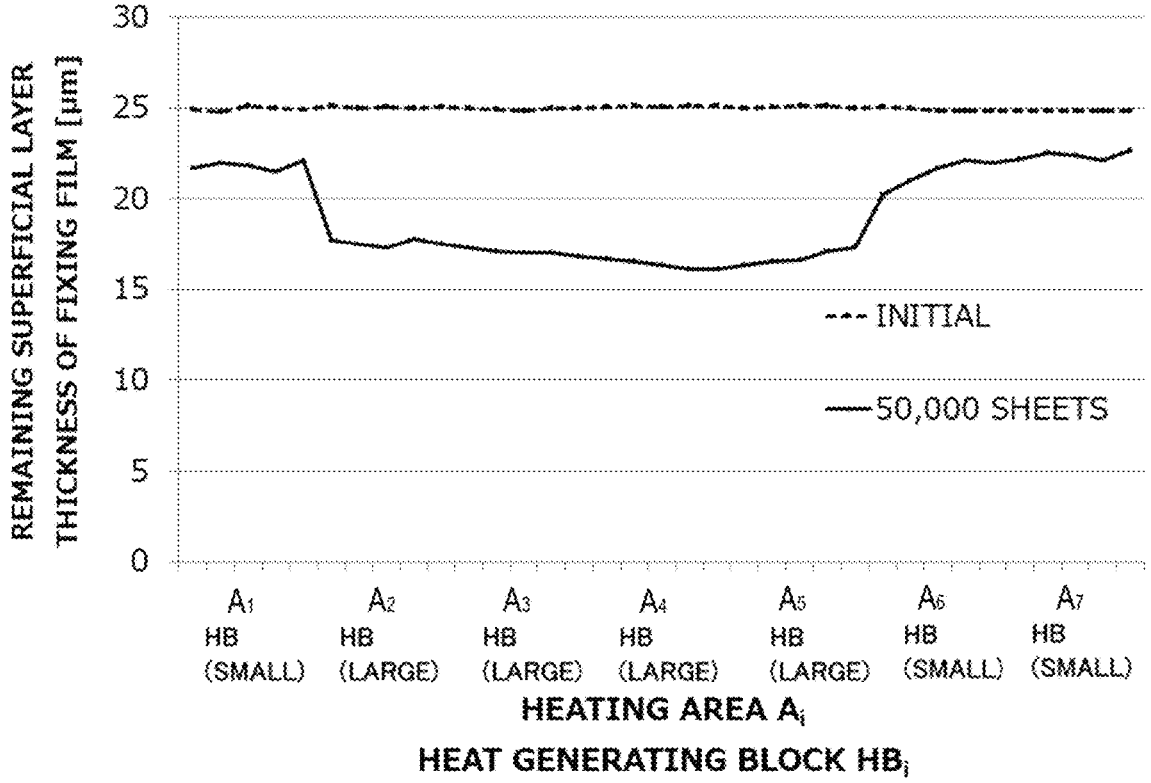
FIG. 13 is an explanatory diagram of the embodiment of the present invention.

FIG. 13 shows a result of measuring an amount of superficial layer abrasion of the fixing film 202. An abscissa of the graph represents a heating area $A_i$ (a heat generating block $HB_i$). An ordinate represents a superficial layer film thickness of the fixing film 202 at a time point where a 50,000th sheet is passed and shows that, the larger a numerical value, the smaller an amount of superficial layer abrasion. From this result, it is shown that the heating areas $A_2$ to $A_5$ in which an image is present in the heating area $A_i$ and the fixing control temperature $TGT_i$ is controlled to a high temperature have a large amount of superficial layer abrasion. As shown in FIG. 13, a PFA resin layer of the superficial layer of the fixing film 202 positioned at a heat generating block $HB_{i\ (large)}$ of which a cumulated amount of heat generation has increased becomes thin. A PFA resin layer of the superficial layer of the fixing film 202 positioned at a heat generating block $HB_{i\ (small)}$ of which the cumulated amount of heat generation is small is thick compared to the PFA resin layer of the superficial layer of the fixing film 202 positioned at the heat generating block $HB_{i\ (large)}$. At the same time, a result of measurements of the hardness of the pressure roller 208 and the width of the fixing nip N in accordance with paper passing is shown in Table 4. The hardness is a measurement value taken by an Asker-C hardness tester (an average value of 12 measurement values taken at three locations in a longitudinal direction and four locations in a circumferential direction of the pressure roller 208 under a weight of 9.8 N).

TABLE 4

| Number of passed sheets [sheets] | Hardness [°] | Fixing nip width [mm] |
|---|---|---|
| 0 | 55.7 | 7.3 |
| 50,000 | 54.1 | 7.6 |

Figure 12B:
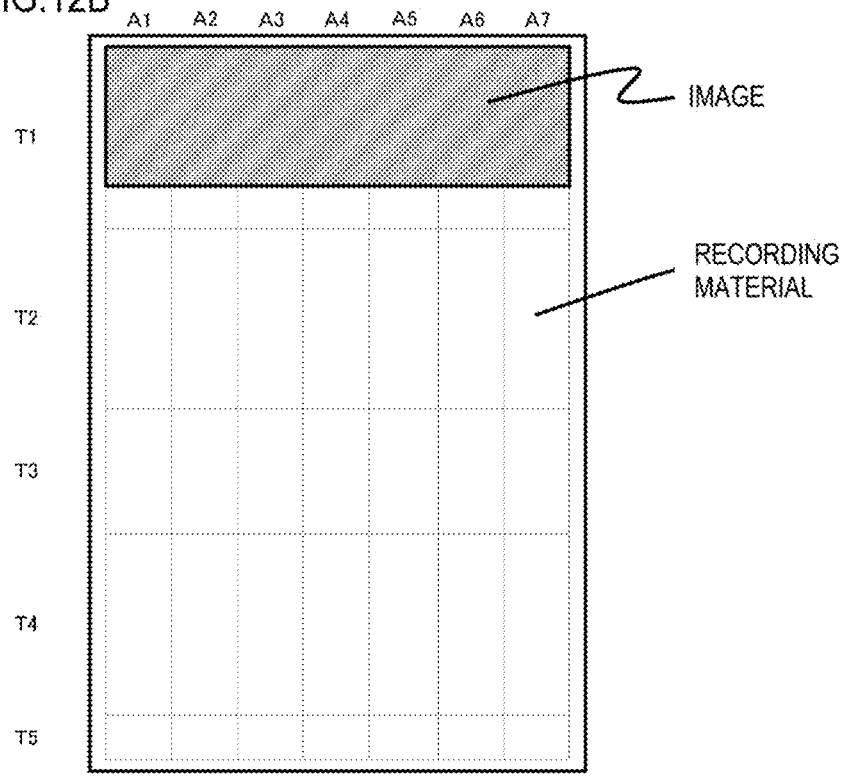

With reference to Table 5, a result of confirming fixing performance will be described when passing paper with an image across an entire longitudinal range as shown in FIG. 12B in a state where a difference in amounts of superficial layer abrasion in the longitudinal direction of the fixing film 208 has occurred and a change of an increased width of the fixing nip N has occurred. In the table, "O" indicates that fixability is not an issue, a hot offset has not occurred, and there is no problem in terms of fixing performance. In the image pattern shown in FIG. 12B, the heating areas $A_1$ to $A_7$ in the section $T_1$ are controlled at the fixing control temperature $TGT_i$ using an image heating area reference temperature as a reference but the other sections $T_2$ to $T_5$ are controlled at the fixing control temperature $TGT_i$ using a reference temperature of a non-image heating area as a reference.

TABLE 5

| Heating area | | Comparative example $A_1, A_6, A_7$ | Comparative example $A_2, A_3, A_4, A_5$ | Embodiment $A_1, A_6, A_7$ | Embodiment $A_2, A_3, A_4, A_5$ |
|---|---|---|---|---|---|
| Passed paper | Initial | O | O | O | O |
| | 50,000 sheets | O | Hot offset | O | O |

Since the comparative example is configured so that control is performed at the same fixing control temperature $TGT_i$ regardless of the heat generating block $HB_i$, the heating areas $A_1$, $A_6$, and $A_7$ and the heating areas $A_2$, $A_3$, $A_4$, and $A_5$ which have different superficial layer thicknesses are controlled at the same fixing control temperature $TGT_i$. Therefore, while the fixing performance of the heating areas $A_1$, $A_6$, and $A_7$ with a small amount of superficial layer abrasion is not an issue, in the heating areas $A_2$, $A_3$, $A_4$, and $A_5$ with a larger amount of superficial layer abrasion and therefore a thinner superficial layer, an amount of supplied heat becomes excessive. An increased fixing nip width also contributes to an occurrence of a hot offset.

On the other hand, in the present embodiment, the fixing control temperature $TGT_i$ is subjected to a correction corresponding to an increase in the width of the fixing nip N. In addition thereto, a correction is applied for reducing an amount of heat generation of the heat generating blocks $HB_2$, $HB_3$, $HB_4$, and $HB_5$ corresponding to the heating areas $A_2$, $A_3$, $A_4$, and $A_5$ with a larger amount of superficial layer abrasion of the fixing film 202. Accordingly, suppression of an occurrence of a hot offset is realized.

While an occurrence of a hot offset becomes an issue in the comparative example of a case of the experimental example described above, the following case may occur depending on an abrasion state of the fixing film 202.

When an image pattern that causes abrasion of the heating area $A_i$ corresponding to an end portion of the recording material P to increase is passed, an amount of heat supplied in the heating area $A_i$ corresponding to the end portion of the recording material P becomes excessive. As a result, a curl phenomenon may become an issue in which both end portions that is orthogonal to the transport direction of the recording material P to be discharged to the outside of the image forming apparatus 100 curl and deform.

Even in such a case, according to the present embodiment, by performing a correction of reducing an amount of heat generation of the heat generating block $HB_i$ of the heating area $A_i$ corresponding to the end portion of the recording material P, the amount of heat supplied to the end portion of the recording material P can be made appropriate and a curl phenomenon can be suppressed.

As described above, in the control according to the first embodiment of the present invention, a correction of a fixing control temperature is executed which is suitable for a change in physical properties of the fixing film 208 and the pressure roller 208 caused depending on use conditions of the user. Accordingly, an image heating apparatus which enables stable fixing performance to be always obtained regardless of the use conditions of the user can be provided. In other words, in an image heating apparatus using a heating source which controls heat generation of a plurality of heat generating elements in accordance with image information, depending on the use conditions of the user, a difference in physical properties may occur in the longitudinal direction of each member forming the image heating apparatus. Even in such a case, by independently controlling an amount of heat generation of the plurality of heat generating elements in accordance with the difference in physical properties having occurred in the longitudinal direction, an amount of heat supplied to a recording material or toner can be made constant regardless of the difference in physical properties having occurred in the longitudinal direction. Therefore, according to the present embodiment, an image heating apparatus which enables stable fixing performance to be obtained regardless of use conditions of a user can be provided.

While a cumulative amount of heat generation of each heat generating block $HB_i$ has been defined in the present embodiment as a product of a control target temperature during execution of a fixing/heating operation and a passage time of a recording material, alternatively, the cumulative amount of heat generation of each heat generating block $HB_i$ may be acquired by cumulating products of a heater detection temperature of temperature detecting elements or an amount of power supplied to each heat generating element and the passage time of the recording material.

Second Embodiment

A second embodiment of the present invention will be described. As an application of the first embodiment, the second embodiment is related to control for suppressing abrasion of the superficial layer of the fixing film 202 which corresponds to a heating area $A_i$ with an increased cumulative amount of heat generation. In the second embodiment, components in common with those of the first embodiment are assigned same reference characters and reiterative descriptions thereof will be omitted. It is to be understood that matters not particularly described in the second embodiment are similar to those described in the first embodiment. As illustrated in FIG. 13, a PFA resin layer of the superficial layer of the fixing film 202 corresponding to a heat generating block $HB_{i\ (large)}$ of which a cumulated amount of heat generation has increased becomes thin. A PFA resin layer corresponding to the heat generating block $HB_{i\ (small)}$ of which the cumulated amount of heat generation is small has a small amount of abrasion and is thick compared to the PFA resin layer of the heat generating block $HB_{i\ (large)}$. When the thicknesses of PFA resin layers differ in this manner, heat capacities of the PFA resin layers also differ. The following problem may occur when there is a difference in heat capacities between the PFA resin layers of the fixing film 202.

A difference is created among times required to raise a surface temperature of the fixing film 202 in response to receiving an image formation signal from the user to 180° C. that is a temperature at which fixing can be performed. The time required to raise the temperature is shorter for the heat generating block $HB_{i\ (large)}$ with a thinner PFA resin layer as compared to the heat generating block $HB_{i\ (small)}$ which retains a thick PFA resin layer. In control of starting up the fixing apparatus 200 according to the comparative example, energization to each heat generating block $HB_i$ of the heater 300 is simultaneously started at a prescribed timing. Therefore, when simultaneously starting energization to the heat generating block $HB_{i\ (large)}$ and the heat generating block $HB_{i\ (small)}$, the surface temperature of the fixing film 202 reaches 180[° C.] earlier in the heat generating block $HB_{i\ (large)}$ than in the heat generating block $HB_{i\ (small)}$. A result of an observation of the surface temperature of the fixing film 202 is shown in FIG. 14.

Figure 14:
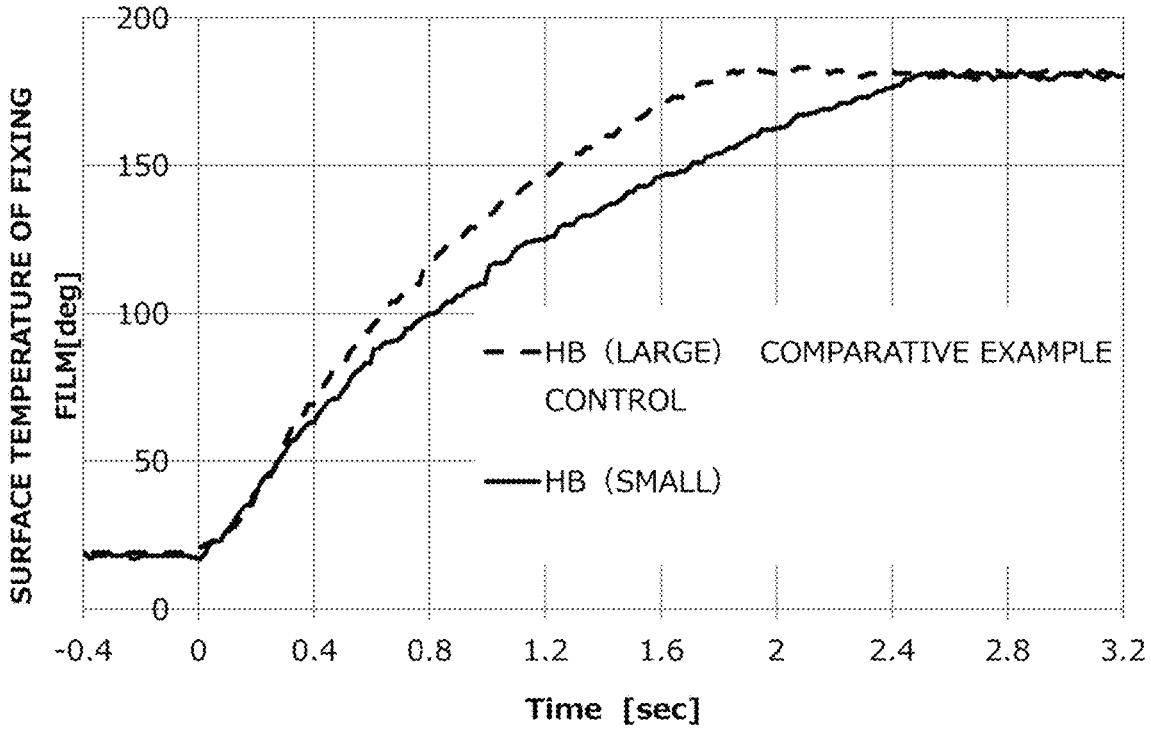
FIG. 14 is an explanatory diagram of a problem of a second embodiment of the present invention.

As shown in FIG. 14, power control of the heat generating block $HB_{i\ (large)}$ having reached the target temperature first is continued until a detected temperature of a thermistor $TH_{(small)}$ positioned in the heat generating block $HB_{(small)}$ reaches a target fixing control temperature $TGT_i$. Therefore, an amount of stored heat of a portion corresponding to the heat generating block $HB_{i\ (large)}$ including the pressure roller 208 increases. As a result, the portion corresponding to the heat generating block $HB_{i\ (large)}$ has a disadvantage in terms of an occurrence of a hot offset and abrasion of the PFA resin layer due to an excessive amount of supplied heat.

In consideration thereof, in the second embodiment, the following control is carried out when a difference between the heat generating block $HB_{(large)}$ of which the PFA resin layer of the fixing film 202 is presumed to be thin and the heat generating block $HB_{(small)}$ of which the PFA resin layer of the fixing film 202 is presumed to be thick equals or exceeds a prescribed value arbitrarily set in the fixing apparatus 200. Specifically, the control involves delaying an energization start timing to the heat generating block $HB_{i\ (large)}$ as compared to the heat generating block $HB_{i\ (small)}$ and reducing a difference between timings at which the respective heat generating blocks reach a prescribed target temperature to make an amount of supplied heat adequate. While the cumulative heat generation count value CAFi according to the first embodiment is used to determine the energization start timing, alternatively, the determination may be made using a separately-defined value that indicates a cumulative amount of heat generation. According to this control, the amount of supplied heat is prevented from becoming excessive, a hot offset can be avoided, and a reduction in abrasion of the PFA resin layer is realized.

Figure 15A:
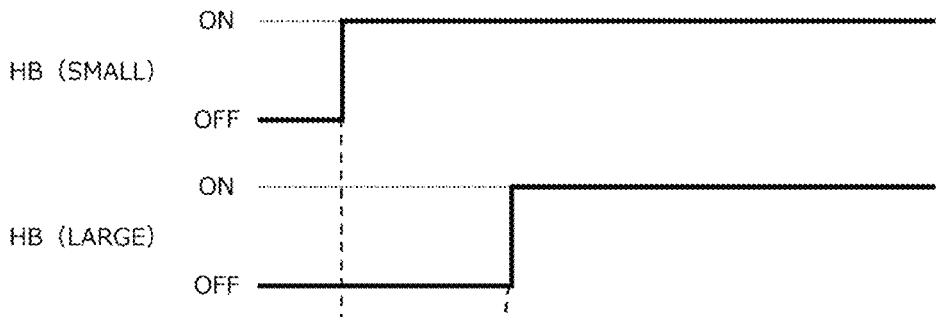
FIGS. 15A and 15B are explanatory diagrams of control of the second embodiment of the present invention.

As shown in FIG. 15A, in the second embodiment, the energization start timing to the heat generating block $HB_{i\ (large)}$ is delayed with respect to the energization start timing to the heat generating block $HB_{(small)}$. By delaying the energization start timing to the heat generating block $HB_{(large)}$, excessive heat storage in a portion corresponding to the heat generating block $HB_{(large)}$ is suppressed, a hot offset is avoided, and a reduction in abrasion of the PFA resin layer is realized. As a result of an examination, in the fixing apparatus 200 according to the present embodiment, when a difference in count values CAFi between the respective heat generating blocks $HB_i$ equals or exceeds the values shown in Table 6, the energization start timing to the heat generating block $HB_{i\ (large)}$ of which the count value CAFi had increased is delayed in accordance with Table 6.

TABLE 6

| Difference in count value $CAF_i$ | Delay time of energization start timing [seconds] |
|---|---|
| 3,000 ~ 4,000 | 0.2 |
| 4,001 ~ 5,500 | 0.3 |
| 5,501 ~ 7,500 | 0.4 |
| 7,501 ~ 10,000 | 0.5 |
| 10,000 or more | 0.6 |

For example, when the count values $CAF_i$ of the heat generating block $HB_{(large)}$ and a heat generating block $HB_{(thick)}$ are respectively 42,300 and 36,900, a difference thereof is 5600. Therefore, the energization start timing of the heat generating block $HB_{(large)}$ is to be delayed by 0.4 [seconds] with respect to the heat generating block $HB_{(small)}$ which is electrified at a standard energization start timing of the fixing apparatus 200. It should be noted that the delay time of the energization start timing is to be determined in consideration of the configuration of the fixing apparatus 200 and is not limited to the numerical values listed in Table 6.

A result of a verification of the effects of the second embodiment in which the controls described above are performed will be shown. The verification of the effects involved repeating successively passing three sheets of the same image pattern (FIG. 12A) as described in the first embodiment on an A4-size recording material P, standing by, successively passing three sheets, and so on. In addition, as the fixing apparatus 200 in which abrasion of the superficial layer of the fixing film 202 has advanced, the fixing apparatus 200 used to describe the first embodiment after passing paper up to 100,000 sheets was used.

Count values $CAF_2$ to $CAF_5$ of the heat generating blocks $HB_2$ to $HB_5$ which are heat generating blocks $HB_{(large)}$ are 25,956, and count values $CAF_1$, $CAF_6$, and $CAF_7$ of the heat generating blocks $HB_1$, $HB_6$, and $HB_7$ which are heat generating blocks $HB_{(small)}$ with a small cumulative amount of heat generation are respectively 20,736. A difference thereof is 5220. According to Table 6, the delay time of an energization start timing for a difference of 5220 between count values CAFi is 0.4 [seconds], and the energization start timing to the heat generating blocks $HB_2$ to $HB_5$ is delayed by 0.4 [seconds].

Figure 15B:
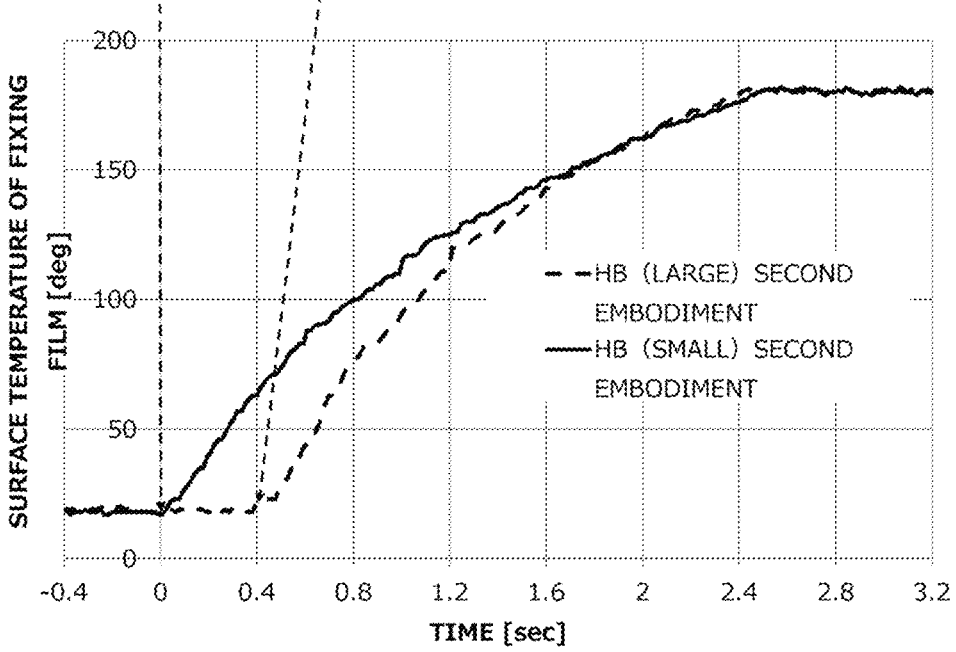

As shown in FIG. 15B, by delaying the energization start timing to the heat generating block $HB_{(large)}$, timings where the surface temperature of the fixing film 202 reaches 180 [° C.] at which fixing can be performed are equalized between the heat generating block $HB_{(large)}$ and the heat generating block $HB_{(small)}$. In other words, an amount of stored heat at a position corresponding to the heat generating block $HB_{(large)}$ can be made appropriate.

An effect of the second embodiment will now be described. As the effect, an occurrence of a hot offset and an amount of abrasion of the PFA resin layer of the fixing film 202 when passing an image pattern shown in FIG. 12B were confirmed in a similar manner to the first embodiment described earlier. Although a hot offset occurs in the control according to the comparative example in which the energization start timings of the heat generating block $HB_{(large)}$ and the heat generating block $HB_{(small)}$ are the same, it was confirmed that a hot offset does not occur in the second embodiment.

Figure 16:
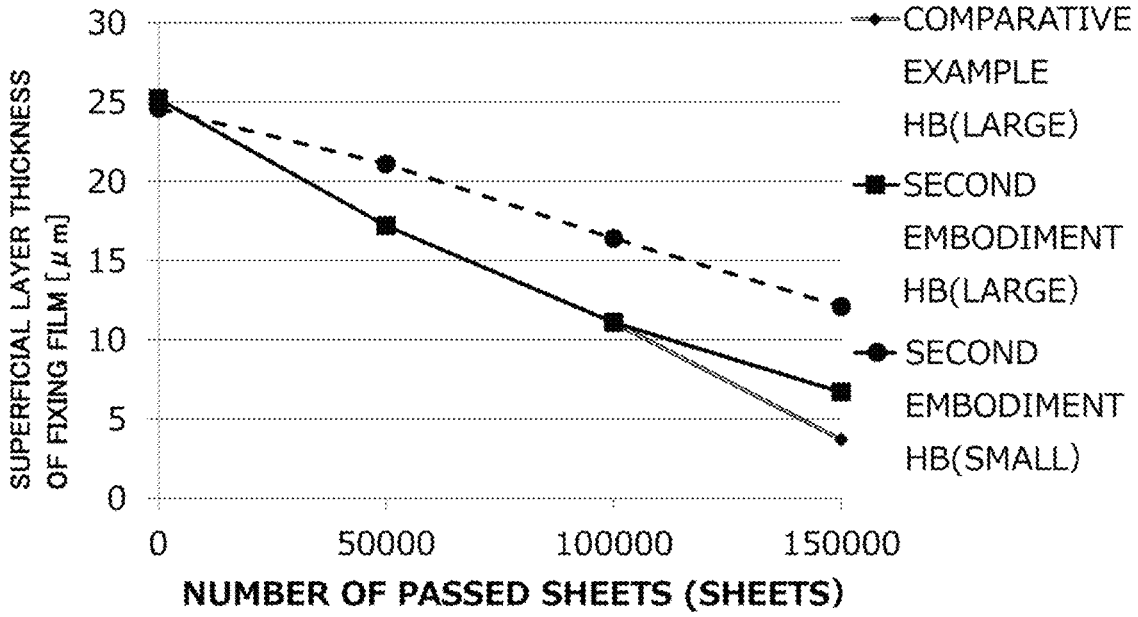
FIG. 16 is an explanatory diagram of effects of the second embodiment of the present invention.

FIG. 16 shows a result of confirming abrasion of a PFA resin layer. In the graph, an abscissa represents the number of passed sheets of the recording material P and an ordinate represents a superficial layer film thickness of the fixing film 202, and it is shown that the thicker the superficial layer film thickness after paper passing, the greater the suppression of superficial layer abrasion. As shown in FIG. 16, compared to control at the energization start timing according to the comparative example even after 100,000 sheets, it was confirmed that passing paper under the control according to the second embodiment enables an amount of abrasion of the PFA resin layer after 100,000 sheets to be reduced. While control which delays the energization start timing to the heat generating block $HB_{(large)}$ is adopted in the second embodiment, since the surface temperature of the fixing film 202 is reliably raised to 180[° C.] at which fixability is obtained, as illustrated in FIG. 15B, it was also confirmed that fixability is not an issue.

While the second embodiment has been described as suppressing a hot offset even when a difference occurs in the superficial layer film thickness of the fixing film 202, various types of the recording material P are used in the image forming apparatus 100 and also include a recording material P known as glossy paper that enables image quality comparable to photographs to be obtained. The image quality of glossy paper is affected by a state of the fixing apparatus 200, and temperature non-uniformity of the surface of the fixing film 202 may sometimes affect uniformity of gloss of a fixed toner image. When paper passing with such glossy paper is selected, the following is conceivable as an application of the second embodiment.

After the surface temperature of the fixing film 202 reaches a temperature at which fixing can be performed, instead of immediately transporting the recording material P to the fixing nip, a transport timing is delayed in order to reliably make the surface temperature uniform. By performing control such that glossy paper is transported to the fixing nip and fixing is performed after making the temperature uniform, even when there is a difference in the superficial layer film thickness of the fixing film 202, image quality uniformity of the glossy paper can be reliably obtained.

As described above, in the second embodiment, the energization start timing of each heat generating block $HB_i$ is adjusted in accordance with superficial layer abrasion of the fixing film 202. Accordingly, each heat generating block $HB_i$ generates heat in accordance with use conditions of the user, and even when a difference occurs in superficial layer abrasion of the fixing film 202, a hot offset or superficial layer abrasion of the fixing film 202 can be suppressed.

Configurations of the respective embodiments described above can be mutually combined to the greatest extent feasible.

Third Embodiment

A third embodiment of the present invention will be described. As described in the first embodiment, a change in hardness of the pressure roller 208 accompanying paper passing increases in an initial stage. When a large number of sheets of a similar pattern are passed under this condition, hardness of an elastic layer declines locally in the longitudinal direction of the pressure roller 208 and the fixing nip N becomes uneven in the longitudinal direction of the pressure roller. In order to address this issue, the third embodiment suppresses a difference in hardness of the pressure roller 208 between a position of a heat generating block with a long heat generation history and a position of a heat generating block with a short heat generation history. Accordingly, stable transport of the recording material P is realized.

In the case of the first embodiment, first, the correction term TAR of cumulative heat generation history information is calculated from the cumulative rotation time Tsum and the correction term $TAF_i$ of cumulative heat generation history information is calculated from a cumulative amount of heat generation. Next, by correcting an amount of heat generation of each heat generating block $HB_i$ on the basis of a result of the calculation, a partial decline in hardness of the pressure roller 208 is suppressed.

However, while a partial decline in hardness of the pressure roller 208 is suppressed by correcting amounts of heat generation, the difference in hardness of the pressure roller 208 between a heat generating block with a long heat generation history and a heat generating block with a short heat generation history cannot be reduced. When a partial difference in hardness that is equal to or greater than a prescribed difference in hardness is created in the longitudinal direction of the pressure roller 208, the following occurs.

Figure 17A:
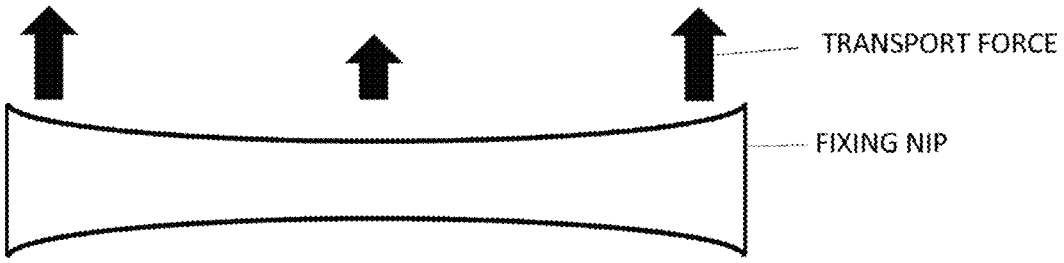
FIGS. 17A to 17C are diagrams showing a shape of a fixing nip.
Figure 17B:
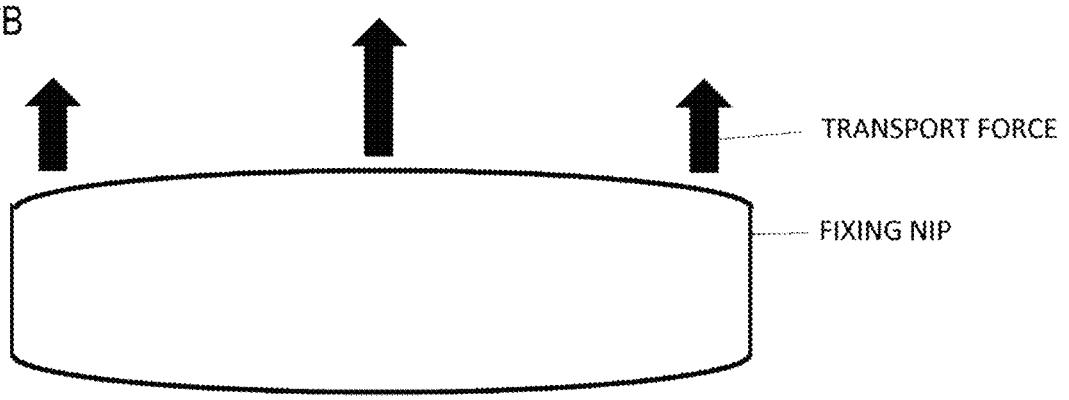

Among various fixing apparatuses 200, there are apparatuses in which the fixing nip N is made into a shape with a central portion that is slightly narrower than end portions in the longitudinal direction as shown in FIG. 17A so that a speed of the recording material P being sandwiched and transported by the fixing nip N is higher at the end portions than in the central portion. Adopting such a shape suppresses an occurrence of wrinkles of the recording material P.

Since a heater of which a heat generating element is not divided generates heat in an even manner in a longitudinal direction of the heater, a change in hardness of the pressure roller 208 is even in the longitudinal direction and a shape of the fixing nip N such as that shown in FIG. 17A can be maintained throughout a lifespan of the pressure roller 208. However, since a heater of which heat generating elements are divided individually controls each heat generating element, a partial decline in hardness of the pressure roller occurs and, as a result, there is a possibility that the shape of the fixing nip N such as that shown in FIG. 17A cannot be maintained.

Figure 18A:
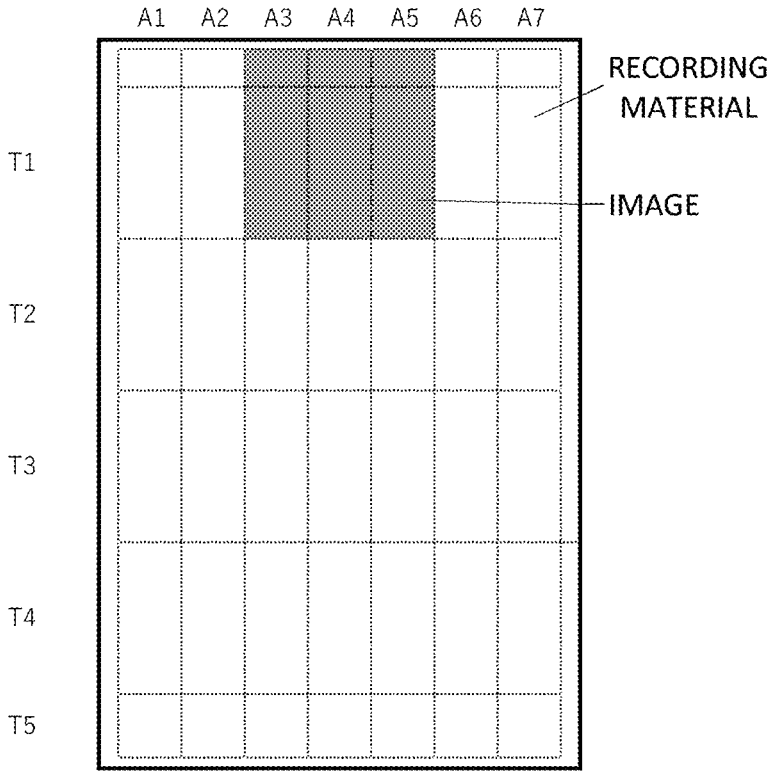
FIGS. 18A and 18B are diagrams showing an image pattern.

As an example, in the case of a toner image such as that shown in FIG. 18A, an amount of heat generation of heat generating blocks $HB_3$, $HB_4$, and $HB_5$ in a central portion increases and, accordingly, an amount of decline in hardness of the central portion of the pressure roller 208 is greater than in longitudinal end portions. Therefore, the fixing nip N ends up having a shape in which the central portion is wider than the end portions. As a speed of the recording material P that is sandwiched and transported by the fixing nip N shaped in this manner, a speed of the central portion is higher than a speed of the longitudinal end portions and, due to an action of a force that causes the recording material P to gather toward a longitudinal center portion, wrinkles occur on the recording material P.

Figure 17C:
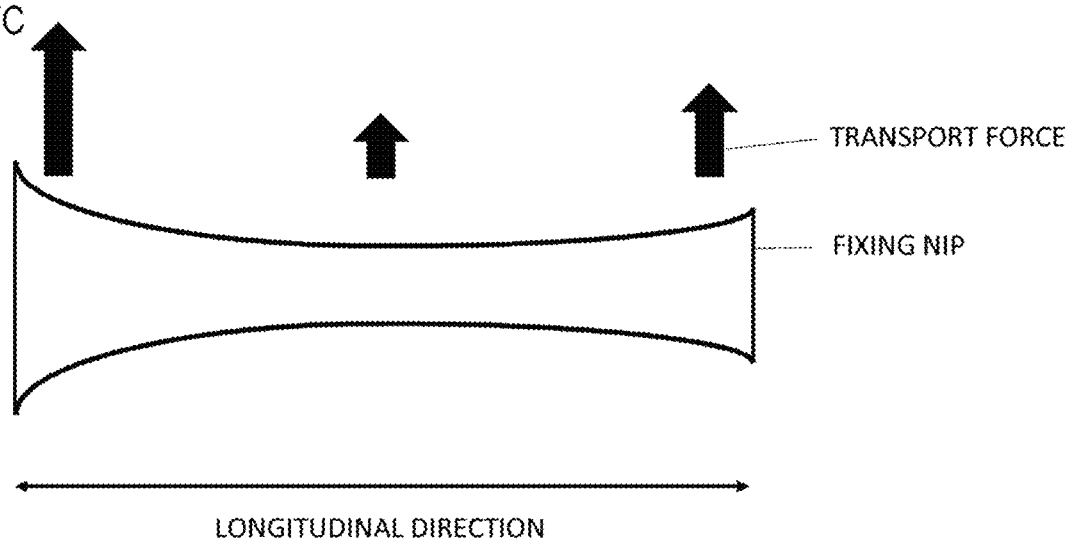
Figure 18B:
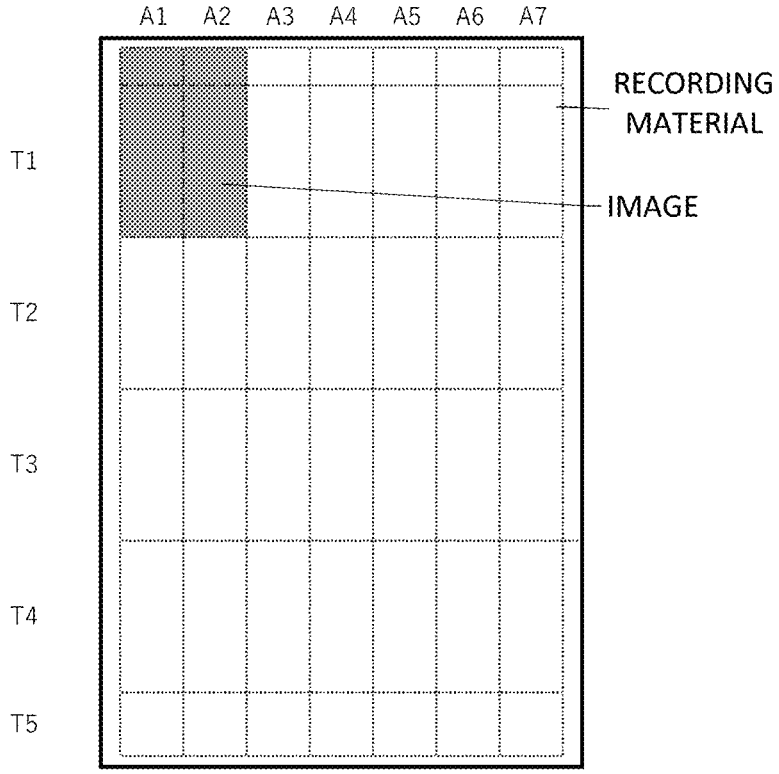

In addition, when a toner image is only present on one side as shown in FIG. 18B, an amount of heat generation of heat generating blocks $HB_1$ and $HB_2$ at the longitudinal end portion (hereinafter, image-side end portion) on a side where the toner image is present increases. As a result, an amount of decline in hardness of the pressure roller at the image-side end portion becomes greater than an amount of decline in hardness of the heat generating blocks $HB_3$, $HB_4$, and $HB_5$ in the central portion and the heat generating blocks $HB_6$ and $HB_7$ at an opposite-side longitudinal end portion (hereinafter, a non-image-side end portion) where an image is not present. As a result, as shown in FIG. 17C, a width of the fixing nip N is expressed as image-side end portion>non-image-side end portion>central portion, thereby resulting in the fixing nip N that is uneven in the longitudinal direction. In the speed of the recording material P that is sandwiched and transported by such a fixing nip N, a speed of the image-side end portion is faster than that of the non-image-side end portion and, consequently, the recording material P is twisted in the fixing nip.

When the recording material P is sandwiched and transported while being twisted in the fixing nip N and in a transfer nip preceding the fixing nip N, as the recording material P exits the transfer nip, a rear end of the image-side end portion of the recording material P flips up toward a side of the fixing film 202 immediately before entering the fixing nip N. Therefore, since the recording material P on which a toner image is formed is transported to the fixing nip N in a state of a one-side loop that is twisted with respect to the fixing nip N, the recording material P rubs against the fixing film 202 and an unfixed toner image is thereby disturbed, and an "image rubbing" phenomenon occurs in which the disturbed unfixed toner image is fixed as is.

Using the image forming apparatus 200 described in the first embodiment, image patterns A and B shown in FIG. 18 were formed on an A4-size recording material P and a durability test up to 150,000 sheets was performed by repeating successively passing three sheets of paper and entering a stationary state. In addition, a width of the fixing nip N and hardness of the pressure roller 208 were measured. At the same time, as conditions under which wrinkles of the recording material P are likely to occur, 50 sheets of the recording material P left to stand in a high temperature, high humidity environment of 30° C. and 80% for two days were successively passed, and wrinkles and image rubbing of the recording material P were confirmed as transportability of the recording material P.

At this point, the hardness of the pressure roller 208 is a measurement value taken by an Asker-C hardness tester (an average value of measurement values taken at four locations in a circumferential direction of the pressure roller 208 positioned in each heat generating block $HB_i$ under a weight of 9.8 N).

As a measurement method of the width of the fixing nip N, first, the recording material P on which a toner image is present over an entire surface is passed so that a print surface-side thereof is on a side of the pressure roller 208, and the passing of the paper is stopped when the recording material P is being sandwiched and transported by the fixing nip N so that a gloss trace of the fixing nip N remains on the recording material. A width of the gloss trace of the fixing nip N (a width in a recording material transport direction) is measured for each position corresponding to each heat generating block $HB_i$.

Results thereof are shown in Table 7 in the case of the image pattern A and in Table 8 in the case of the image pattern B. In the table, "O" indicates that transportability of the recording material P is not an issue and wrinkles and image rubbing have not occurred in the recording material P.

As described in the first embodiment, the heat generating blocks $HB_1$ to $HB_7$ in the tables are heat generating blocks $HB_i$ provided at positions corresponding to the heating areas $A_1$ to $A_7$ shown in FIG. 5.

TABLE 7

| | | FIG. 18A | | | | | | |
|---|---|---|---|---|---|---|---|---|
| Heat generating block | | $HB_1$ | $HB_2$ | $HB_3$ | $HB_4$ | $HB_5$ | $HB_6$ | $HB_7$ |
| Initial | Fixing nip width [mm] | 7.8 | 7.5 | 7.3 | 7.2 | 7.3 | 7.6 | 7.8 |
| | Hardness [°] | 55.5 | 55.8 | 55.6 | 55.8 | 55.7 | 55.6 | 55.7 |
| | Recording material transport-ability | | | | ○ | | | |
| 50,000 sheets | Fixing nip width [mm] | 8.0 | 7.7 | 7.8 | 7.7 | 7.7 | 7.8 | 8.0 |
| | Average hardness [°] | 54.5 | 54.8 | 53.2 | 53.4 | 53.3 | 54.6 | 54.7 |
| | Recording material transport-ability | | | | ○ | | | |
| 100,000 sheets | Fixing nip width [mm] | 8.1 | 7.8 | 8.0 | 8.0 | 8.0 | 7.9 | 8.1 |
| | Average hardness [°] | 54.0 | 54.3 | 51.8 | 52.0 | 51.9 | 54.1 | 54.2 |
| | Recording material transport-ability | | | | ○ | | | |
| 130,000 sheets | Fixing nip width [mm] | 8.1 | 7.9 | 8.3 | 8.2 | 8.2 | 7.9 | 8.1 |
| | Average hardness [°] | 53.7 | 54.0 | 50.7 | 50.9 | 50.8 | 53.8 | 53.9 |
| | Recording material transport-ability | Wrinkles (3/50 sheets) | | | | | | |
| 150,000 sheets | Fixing nip width [mm] | 8.2 | 7.9 | 8.4 | 8.4 | 8.4 | 8.0 | 8.2 |
| | Average hardness [°] | 53.5 | 53.8 | 50.0 | 50.2 | 50.1 | 53.6 | 53.7 |
| | Recording material transpor-tability | Wrinkles (15/50 sheets) | | | | | | |

When the image pattern shown in FIG. 18A is subjected to a fixing process (Table 7), a decline in hardness of the central portion in the longitudinal direction of the pressure roller 208 which is positioned in the heat generating blocks $HB_3$, $HB_4$, and $HB_5$ is greater than a decline in hardness of the end portions. Therefore, since an amount of increase of the width of the fixing nip N is also greater in the central portion in the longitudinal direction, the central portion is wider than the end portions in the shape of the fixing nip N, resulting in the fixing nip N which is uneven in the longitudinal direction. As described earlier, with the uneven fixing nip N in which the central portion is wider than the end portions, since the transportability of the recording material P is unstable, wrinkles occur in the recording material P.

TABLE 8

| | | FIG. 18B | | | | | | |
|---|---|---|---|---|---|---|---|---|
| Heat generating block | | $HB_1$ | $HB_2$ | $HB_3$ | $HE_4$ | $HB_5$ | $HB_6$ | $HB_7$ |
| Initial | Fixing nip width [mm] | 7.8 | 7.6 | 7.2 | 7.2 | 7.3 | 7.6 | 7.8 |
| | Hardness [°] | 55.6 | 55.7 | 55.8 | 55.9 | 55.4 | 55.7 | 55.7 |
| | Recording material transport-ability | | | | ○ | | | |
| 50,000 sheets | Fixing nip width [mm] | 8.3 | 8.1 | 7.4 | 7.4 | 7.5 | 7.8 | 8.0 |
| | Average hardness [°] | 53.1 | 53.2 | 54.8 | 54.9 | 54.4 | 54.7 | 54.7 |
| | Recording material transport-ability | | | | ○ | | | |
| 100.000 sheets | Fixing nip width [mm] | 8.7 | 8.5 | 7.6 | 7.6 | 7.7 | 7.9 | 8.1 |
| | Average hardness [°] | 51.1 | 51.2 | 54.1 | 54.2 | 53.7 | 54.0 | 54.0 |
| | Recording material transport-ability | | | | ○ | | | |
| 130,000 sheets | Fixing nip width [mm] | 8.9 | 8.7 | 7.6 | 7.6 | 7.7 | 8.0 | 8.2 |
| | Average hardness [°] | 50.2 | 50.3 | 53.8 | 53.9 | 53.4 | 53.7 | 53.7 |
| | Recording material transport-ability | Image nibbing (2/50 sheets) | | | | | | |

TABLE 8-continued

| | | FIG. 18B | | | | | | |
|---|---|---|---|---|---|---|---|---|
| Heat generating block | | $HB_1$ | $HB_2$ | $HB_3$ | $HE_4$ | $HB_5$ | $HB_6$ | $HB_7$ |
| 150,000 sheets | Fixing nip width [mm] | 9.1 | 8.8 | 7.7 | 7.7 | 7.8 | 8.0 | 8.2 |
| | Average hardness [°] | 49.6 | 49.7 | 53.6 | 53.7 | 53.2 | 53.5 | 53.5 |
| | Recording material transport-ability | Image rubbing (12/50 sheets) | | | | | | |

When the image pattern shown in FIG. 18B is subjected to a fixing process (Table 8), a decline in hardness of image-side end portions of the pressure roller 208 which are positioned in the heat generating blocks $HB_1$ and $HB_2$ is greater than a decline in hardness of the central portion. Therefore, since an amount of increase of the width of the fixing nip N is also greater in the image-side end portions, an uneven fixing nip N is created in which the width of the fixing nip N on one side of a longitudinal end portion increases. As described earlier, when paper is passed through an uneven fixing nip N in which the width of the fixing nip N on one side is increased, the recording material P enters a state of a one-side loop and image rubbing occurs.

On the basis of the results described above, average values of the hardness of the pressure roller 208 corresponding to respective positions of the heat generating blocks $HB_1$ and $HB_2$ in the longitudinal end portion, the heat generating blocks $HB_6$ and $HB_7$ in the opposite-side longitudinal end portion, and the heat generating blocks $HB_3$, $HB_4$, and $HB_5$ in the longitudinal center portion are calculated. In addition, average values of the width of the fixing nip N are also calculated. An average width of the fixing nip N when subtracting the calculated width of the fixing nip N in the central portion from the calculated width of the fixing nip N in the end portion and an average hardness of the pressure roller 208 when subtracting the calculated hardness of the fixing nip N in the central portion from the calculated hardness of the fixing nip N in the end portion are calculated. Results thereof as well as an occurrence status of wrinkles and image rubbing of the recording material P are compiled and shown in Table 9.

In the table, "O" indicates that transportability of the recording material P is not an issue and wrinkles and image rubbing have not occurred in the recording material P.

TABLE 9

| End portion - central portion fixing nip width [mm] | End portion - central portion pressure roller hardness [°] | Wrinkles | Image rubbing |
|---|---|---|---|
| −0.3 | 3.6 | X | O |
| −0.2 | 3.1 | Δ | O |
| 0 | 2.5 | O | O |
| 0.1 | 1.3 | O | O |
| 0.4 | 0.0 | O | O |
| 0.7 | −1.5 | O | O |
| 1 | −2.8 | O | O |
| 1.2 | −3.4 | O | Δ |
| 1.3 | −3.8 | O | X |

As shown in Table 9, it was found that wrinkles occur in the recording material P when the width of the fixing nip N in the central portion exceeds the width of the fixing nip B in the end portion by more than 0.2 [mm], and image rubbing occurs due to the creation of a fixing nip N which is uneven in the longitudinal direction when the width of the fixing nip N in the longitudinal end portion on one side exceeds the width of the fixing nip N in the central portion by more than 1.2 [mm].

The third embodiment realizes stable transportability of the recording material P in which wrinkles and image rubbing of the recording material P do not occur by controlling amounts of heat generation of the divided heat generating blocks so that the fixing nip N can be maintained in a shape where a central portion is narrower than longitudinal end portions throughout the lifespan thereof.

In a control method that realizes stable transportability of the recording material P, first, a correction value is obtained from a sum of the correction term TAR of cumulative heat generation history information and the correction term $TAF_i$ of cumulative heat generation history information of each heat generating block $HB_i$. Using a value calculated from a difference between a maximum value and a minimum value among the respective heat generating blocks of the correction value, a manner in which a heat generating block $HB_{i\ (small)}$ with a short heat generation history generates heat is controlled to reduce a difference in heat generation histories.

The result of Table 9 and a result that summarizes maximum differences of the correction value among the respective heat generating blocks are shown in Table 10. The calculation methods described in the first embodiment are used with respect to the correction term TAR and the correction term $TAF_i$.

TABLE 10

| End portion - central End portion fixing nip width [mm] | portion - central portion pressure: roller hardness [°] | Wrinkles | Image rubbing | Difference between maximum and minimum correction values among respective $HB_i$ |
|---|---|---|---|---|
| −0.3 | 3.6 | X | O | 4 |
| −0.2 | 3.1 | Δ | O | 4 |
| 0 | 2.5 | O | O | 2 |
| 0.1 | 1.3 | O | O | 2 |
| 0.4 | 0.0 | O | O | 0 |
| 0.7 | −1.5 | O | O | 2 |
| 1 | −2.8 | O | O | 2 |
| 1.2 | −3.4 | O | Δ | 4 |
| 1.3 | −3.8 | O | X | 4 |

The results show that, when a difference in correction values between the heat generating block $HB_{i\ (large)}$ with a long heat generation history and the heat generating block $HB_{i\ (small)}$ with a short heat generation history which constitutes a maximum difference in correction values is larger than 2, wrinkles or image rubbing of the recording material P sometimes occur. In contrast, by performing control according to the present embodiment which increases a cumulative amount of heat generation of the heat generating block $HB_{i\ (small)}$, the difference in correction values can be limited to or below 2. As a result, the difference in amounts of heat generation between the heat generating block $HB_{i\ (small)}$ and the heat generating block $HBi_{(large)}$ can be limited to or below a prescribed value.

Figure 19:
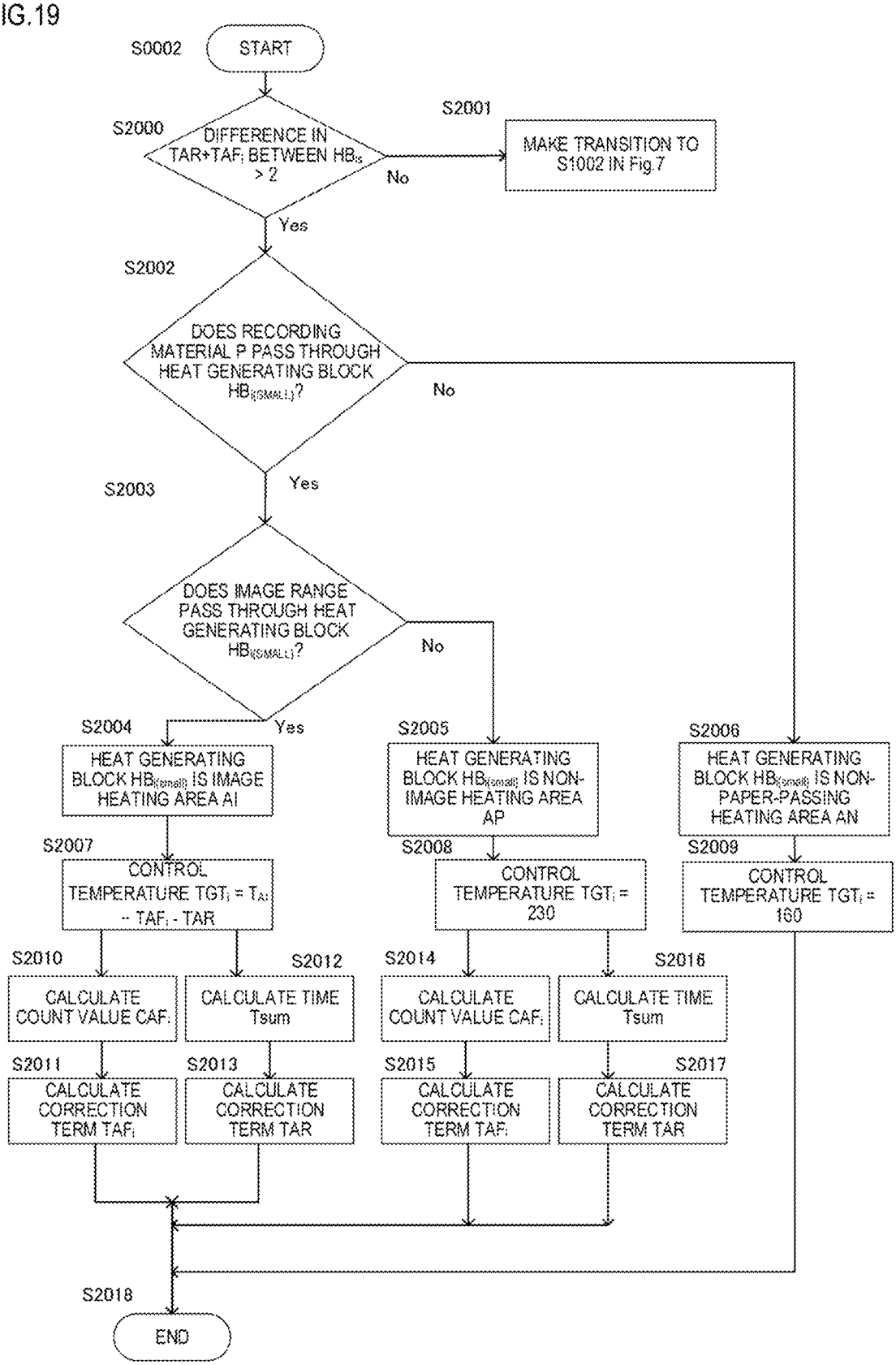
FIG. 19 is a flow chart according to a third embodiment of the present invention.

The control according to the third embodiment will now be described with reference to the flow chart shown in FIG. 19. A sum of correction values of the correction term TAR and the correction term $TAF_i$ of each heat generating block HB is calculated, and when a difference between heat generating blocks $HB_i$ is equal to or smaller than 2, a transition is made to S2001 and control that is similar to that of the first embodiment is performed. When the difference between heat generating blocks $HB_i$ is greater than 2, a transition is made to S2002 (S2000). A determination is made as to whether or not the recording material P passes through the heat generating block $HB_{i\ (small)}$ with a short heat generation history (S2002), and when the recording material P does not pass through the heat generating block $HB_{i\ (small)}$, the heating area $A_i$ is classified as a non-paper-passing heating area AN (S2006). When the recording material P passes through the heat generating block $HB_{i\ (small)}$ with a short heat generation history, a determination is made as to whether or not an image range passes through the heat generating block $HB_{i\ (small)}$ (S2003). When the image range passes through the heat generating block $HB_{i\ (small)}$, the heat generating block $HB_{i\ (small)}$ is classified as an image heating area AI (S2004), but when the image range does not pass through the heat generating block $HB_{i\ (small)}$, the heat generating block $HB_{i\ (small)}$ is classified as a non-image heating area AP (S2005).

When the heat generating block $HB_{i\ (small)}$ with a short heat generation history is classified as an image heating area AI, the fixing control temperature $TGT_i$ of the heat generating block $HB_{i\ (small)}$ is set to the fixing control temperature $TGT_i = T_{AI} - TAF_i - TAR$ described in the first embodiment (S2007).

When the heat generating block $HB_{i\ (small)}$ with a short heat generation history is classified as a non-image heating area AP, the fixing control temperature $TGT_i$ of the heat generating block $HB_{i\ (small)}$ is set to a temperature that is higher than the reference temperature $T_{AI}$=220° C. of an image heating area. Accordingly, control for increasing a heat generation history of the heat generating block $HB_{i\ (small)}$ with a short heat generation history is executed. In doing so, excessively raising the temperature of the heat generating block $HB_{i\ (small)}$ may cause a hot offset to occur due to heat transferred to the fixing film 202 in the image heating area AI where a toner image is present. An experiment carried out by the present inventors and the like revealed that, in the image heating apparatus 200 according to the present embodiment, a hot offset is prevented from occurring in an image when the control temperature $TGT_i$ of the non-image heating area AP is 230° C. or lower. In the present embodiment, the fixing control temperature $TGT_i$ of the non-image heating area AP is set to 230° C. (S2008).

Finally, a case where the heat generating block $HB_{i\ (small)}$ with a short heat generation history is classified as a non-paper-passing heating area AN (S2006) will be described. Control for increasing a heat generation history of the heat generating block $HB_{i\ (small)}$ with a short heat generation history is executed by raising the temperature of the heat generating block $HB_{i\ (small)}$ above the setting value according to the first embodiment. In doing so, when a set temperature of the heat generating block $HB_{i\ (small)}$ with a short heat generation history is excessively raised, since heat in this area is not taken away by the recording material P, temperatures of the fixing film 202 and the pressure roller 208 rise. This rise in temperature also affects the image heating area AI. When a recording material P bearing an unfixed toner image is passed in a state where the temperatures of the fixing film 202 and the pressure roller 208 have risen, too much heat is supplied to the toner and a hot offset occurs. An experiment carried out by the present inventors and the like revealed that, in the image heating apparatus 200 according to the present embodiment, a hot offset is prevented from occurring in an image on the recording material P when the control temperature $TGT_i$ of the non-image heating area AN of the heat generating block $HB_{i\ (small)}$ is 160° C. or lower. Therefore, a control temperature of the non-paper-passing heating area AN of the heat generating block $HB_{i\ (small)}$ is set such that $TGT_i$=160[° C.] (S2009).

A result of a verification of the effects of the third embodiment in which the controls described above is performed will be shown. Using the image forming apparatus 200 described in the first embodiment, the image pattern shown in FIG. 12A was formed on an A4-size recording material P and a durability test up to 150,000 sheets was performed by repeating successively passing three sheets of paper and then stopping. In addition, a width of the fixing nip N and hardness of the pressure roller 208 were measured. Accordingly, an average hardness of the pressure roller and an average fixing nip width respectively corresponding to the heat generating blocks $HB_3$, $HB_4$, and $HB_5$ in the longitudinal center portion, the heat generating blocks $HB_1$ and $HB_2$ near the longitudinal end portion, and the heat generating blocks $HB_6$ and $HB_7$ near the opposite-side longitudinal end portion were measured.

At the same time, 50 sheets of the recording material P left to stand in a high temperature, high humidity environment (30° C. and 80%) for two days as conditions under which wrinkles of the recording material P are likely to occur were successively passed, and wrinkles and image rubbing of the recording material P were confirmed.

The first embodiment was used as a comparative example in order to compare results of the present embodiment, and respective results are shown in Table 11. In the table, "O" indicates that transportability of the recording material P is not an issue and wrinkles and image rubbing have not occurred in the recording material P.

TABLE 11

| | | Comparative example | | | Third embodiment | | |
|---|---|---|---|---|---|---|---|
| Heat generating block | | $HB_1$, $HB_2$ | $HB_3$, $HB_4$, $HB_5$ | $HB_6$, $HB_7$ | $HB_1$, $HB_2$ | $HB_3$, $HB_4$, $HB_5$ | $HB_6$, $HB_7$ |
| Initial | Average hardness [°] | 55.5 | 55.8 | 55.7 | 55.6 | 55.9 | 55.4 |
| | Average fixing nip width [mm] | 7.8 | 7.2 | 7.8 | 7.8 | 7.2 | 7.8 |
| | Recording material transportability | | ○ | | | ○ | |
| 150,000 sheets | Average hardness [°] | 53.5 | 50.2 | 54 | 52.1 | 50.3 | 52.2 |
| | Average fixing nip width [mm] | 8.2 | 8.4 | 8.1 | 8.5 | 8.3 | 8.5 |
| | Recording material transportability | Wrinkles (18/50 sheets) | | | | ○ | |

In the first embodiment used as a comparative example, a comparison of the width of the fixing nip N when passing 150,000 sheets of paper reveals that a fixing nip N with a wider central portion than longitudinal end portions is formed and wrinkles of the recording material P have occurred.

On the other hand, in the third embodiment, by increasing the amounts of heat generation of the heat generating blocks $HB_1$, $HB_2$, $HB_6$, and $HB_7$ with a short heat generation history to reduce a difference from the heat generating blocks $HB_3$, $HB_4$, and $HB_5$ with a long heat generation history to a prescribed value or lower, an occurrence of wrinkles of the recording material P is suppressed.

While the occurrence of wrinkles of the recording material P poses a problem in the comparative example described above, depending on a state of hardness of the pressure roller 208, the following case may occur. When an image pattern shown in FIG. 18B which causes hardness of a longitudinal end portion of the pressure roller 208 to decline is passed, the hardness of the pressure roller in an image-side end portion of the pressure roller 208 decreases and a transport force near a longitudinal end portion of the pressure roller 208 significantly increases as compared to a central portion. As a result, a one-side loop may conceivably occur in the recording material P discharged to the outside of the image forming apparatus 100. Even in such a case, in the present embodiment, since a correction that increases the amounts of heat generation of the heat generating blocks $HB_3$, $HB_4$, $HB_5$, $HB_6$, and $HB_7$ with a short heat generation history is performed, a difference in hardness in the longitudinal direction of the pressure roller 208 is adjusted to an appropriate amount.

As a verification of effects, a durability test was performed under conditions similar to those described earlier. The first embodiment was used as a comparative example in order to compare results of the present embodiment, and respective results are shown in Table 12.

In the table, "O" indicates that transportability of the recording material P is not an issue and wrinkles and image rubbing have not occurred in the recording material P.

TABLE 12

| Heat generating block | | Comparative example | | | Third embodiment | | |
|---|---|---|---|---|---|---|---|
| | | $HB_1$, $HB_2$ | $HB_3$, $HB_4$, $HB_5$ | $HB_6$, $HB_7$ | $HB_1$, $HB_2$ | $HB_3$, $HB_4$, $HB_5$ | $HB_6$, $HB_7$ |
| Initial | Average hardness [°] | 55.7 | 55.7 | 55.6 | 55.5 | 55.8 | 55.6 |
| | Average fixing nip width [mm] | 7.8 | 7.3 | 7.8 | 7.8 | 7.2 | 7.8 |
| | Recording material transport-ability | | ○ | | | ○ | |
| 150,000 sheets | Average hardness [°] | 50.5 | 54 | 53.9 | 50.3 | 51.8 | 51.8 |
| | Average fixing nip width [mm] | 8.8 | 7.6 | 8.1 | 8.8 | 8.0 | 8.5 |
| | Recording material transport-ability | Image rubbing (12/50 sheets) | | | | ○ | |

In the first embodiment used as a comparative example, when passing 150,000 sheets of paper, a fixing nip N with wider image-side end portions than the central portion is formed. On the other hand, in the third embodiment, by increasing the amounts of heat generation of the heat generating blocks $HB_3$, $HB_4$, $HB_5$, $HB_6$, and $HB_7$ with a short heat generation history to reduce a difference from the heat generating blocks $HB_1$ and $HB_2$ with a long heat generation history, an occurrence of image rubbing of the recording material P can be suppressed.

As described above, in the third embodiment, by executing a correction of a fixing control temperature which is suitable for a change in hardness of the pressure roller 208 caused under use conditions of the user, an image heating apparatus that always produces stable transport performance can be provided regardless of the use conditions of the user.

According to the present invention, an image heating apparatus which enables stable fixing performance to be obtained regardless of use conditions of a user can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus, comprising:

an image heating portion which has a heater including a substrate and a plurality of heat generating elements provided on the substrate and aligned in a longitudinal direction of the substrate, a cylindrical film that rotates while an inner surface thereof comes into contact with the heater, and a pressing member that comes into contact with an outer surface of the film and rotates, the image heating portion heating an image formed on a recording material using heat of the heater while sandwiching and transporting the recording material at a nip portion between the film and the pressing member; and an energization control portion which selectively controls energization to the plurality of heat generating elements so as to selectively heat a plurality of heating areas in accordance with information of the image, wherein the image heating apparatus includes an acquisition portion which acquires a cumulative amount of heat generation of the heat generating element in each of the plurality of heating areas, a cumulative rotation time of the pressing member, and information about the recording material that passes through the nip portion, and the energization control portion sets a control target temperature of each of the plurality of heating areas when controlling energization to the plurality of heat generating elements on the basis of the information acquired by the acquisition portion.

2. The image heating apparatus according to claim 1, wherein the energization control portion respectively corrects the control target temperatures on the basis of the cumulative amount of heat generation in each of the plurality of heating areas and the cumulative rotation time.

3. The image heating apparatus according to claim 2, wherein the acquisition portion acquires, as the cumulative amount of heat generation, a value calculated by cumulating a product of the control target temperature and a time required by the recording material to pass through the nip portion.

4. The image heating apparatus according to claim 2, further comprising:

a temperature detecting portion which detects a temperature of the heater, wherein the acquisition portion acquires, as the cumulative amount of heat generation, a value calculated by cumulating a product of a temperature detected by the temperature detecting portion and the time required by the recording material to pass through the nip portion.

5. The image heating apparatus according to claim 2, wherein the acquisition portion acquires, as the cumulative amount of heat generation, a value calculated by cumulating a product of power supplied to the plurality of heat generating elements and a time required by the recording material to pass through the nip portion.

6. The image heating apparatus according to claim 2, wherein the energization control portion classifies, on the basis of information on the image and information of the recording material, each of the plurality of heating areas into an image heating area in which the recording material and the image are heated, a non-image heating area in which the recording material is heated but the image is not heated, and a non-paper-passing heating area in which neither the recording material nor the image is heated, and sets the control target temperature in accordance with the classification.

7. The image heating apparatus according to claim 1, wherein the information of the recording material at least includes any of a size of the recording material and a type of the recording material.

8. The image heating apparatus according to claim 1, wherein when a difference in the cumulative amount of heat generation between the plurality of heating areas is equal to or larger than a prescribed value, the energization control portion differentiates a timing of energization to the heat generating elements for each of the plurality of heating areas so as to reduce a difference among timings at which a temperature of each of the plurality of heating areas rises to a prescribed temperature.

9. The image heating apparatus according to claim 1, wherein the energization control portion respectively controls an amount of heat generation of the plurality of heat generating elements so that a difference of the cumulative amount of heat generation among the plurality of heating areas equals or becomes smaller than a prescribed value.

10. The image heating apparatus according to claim 9, wherein the energization control portion performs control an amount of heat generation of a heating area exhibiting a small cumulative amount of heat generation to be larger so that a difference of the cumulative amount of heat generation among the plurality of heating areas equals or becomes smaller than a prescribed value.

11. The image heating apparatus according to claim 1, further comprising a storage portion which stores the cumulative amount of heat generation and the cumulative rotation time.

12. An image forming apparatus, comprising:

an image forming portion which forms an image on a recording material; and a fixing portion which fixes an image formed on the recording material to the recording material, wherein the fixing portion is the image heating apparatus according to claim 1.

13. An image forming apparatus for forming an image on a recording material, comprising:

(A) a image forming portion configured to form the image on the recording material;

(B) a fixing portion configured to fix the image onto the recording material, the fixing portion includes, (a) a cylindrical film;

(b) a heater provided in an inner space of the film, the heater includes a substrate, a plurality of heat generating elements provided on the substrate and aligned in a longitudinal direction of the substrate;

(c) a roller contacting an outer peripheral surface of the film and forming a nip portion in cooperation with the heater through the film, wherein the image formed on the recording material is heated at the nip portion while the recording material passing through the nip portion;

(C) an energization control portion configured to control energization to the plurality of heat generating elements so that each of the plurality of the heat generating elements are maintained at a control target temperature in accordance with information of the image; and (D) an acquisition portion acquires a cumulative amount of heat generation of the heat generating element in each of the plurality of heating areas, and a cumulative rotation time of the pressing member, wherein the energization control portion sets the control target temperature of each of the plurality of heat generating elements when controlling energization to the plurality of heat generating elements on the basis of the information acquired by the acquisition portion.

14. The image forming apparatus according to claim 13, wherein the energization control portion classifies, on the basis of information on the image and information of the recording material, each of a plurality of heating areas heated by each of the plurality of the heat generating elements into an image heating area in which the recording material and the image are heated, a non-image heating area in which the recording material is heated but the image is not heated, and a non-paper-passing heating area in which neither the recording material nor the image is heated, and sets the control target temperature in accordance with the classification.

15. The image forming apparatus according to claim 14, wherein the energization control portion respectively corrects the control target temperatures set according to the classification on the basis of the cumulative amount of heat generation in each of the plurality of heat generating elements and the cumulative rotation time.

16. The image forming apparatus according to claim 15, wherein the acquisition portion acquires, as the cumulative amount of heat generation, a value calculated by cumulating a product of the control target temperature and a time required by the recording material to pass through the nip portion.

17. The image forming apparatus according to claim 15, further comprising:

a temperature detecting portion which detects a temperature of the heater, wherein the acquisition portion acquires, as the cumulative amount of heat generation, a value calculated by cumulating a product of a temperature detected by the temperature detecting portion and the time required by the recording material to pass through the nip portion.

18. The image forming apparatus according to claim 15, wherein the acquisition portion acquires, as the cumulative amount of heat generation, a value calculated by cumulating a product of power supplied to the plurality of heat generating elements and a time required by the recording material to pass through the nip portion.

19. The image forming apparatus according to claim 15, wherein the energization control portion respectively controls an amount of heat generation of the plurality of heat generating elements so that a difference of the cumulative amount of heat generation among the plurality of heating areas equals or becomes smaller than a prescribed value.

20. The image forming apparatus according to claim 19, wherein the energization control portion performs control an amount of heat generation of a heating area exhibiting a small cumulative amount of heat generation to be larger so that a difference of the cumulative amount of heat generation among the plurality of heating areas equals or becomes smaller than a prescribed value.

* * * * *